US012286807B2

(12) United States Patent
Kloepfer

(10) Patent No.: US 12,286,807 B2
(45) Date of Patent: Apr. 29, 2025

(54) MODULAR FENCE

(71) Applicant: Michael Kloepfer, Delhi (CA)

(72) Inventor: Michael Kloepfer, Delhi (CA)

( * ) Notice: Subject to any disclaimer, the term of this patent is extended or adjusted under 35 U.S.C. 154(b) by 375 days.

(21) Appl. No.: 17/720,099

(22) Filed: Apr. 13, 2022

(65) Prior Publication Data

US 2022/0341210 A1 Oct. 27, 2022

Related U.S. Application Data

(60) Provisional application No. 63/177,642, filed on Apr. 21, 2021.

(51) Int. Cl.
*E04H 17/14* (2006.01)
*E04H 17/00* (2006.01)
*E04H 17/20* (2006.01)

(52) U.S. Cl.
CPC ..... *E04H 17/1465* (2021.01); *E04H 17/21* (2021.01); *E04H 17/013* (2021.01)

(58) Field of Classification Search
CPC ..... E04H 17/00; E04H 17/14; E04H 17/1413; E04H 17/1447; E04H 17/1465; E04H 17/1486; E04H 17/1488; E04H 17/16; E04H 17/1602; E04H 17/168; E04H 17/20; E04H 17/21
See application file for complete search history.

(56) References Cited

U.S. PATENT DOCUMENTS 88,819 A * 4/1869 Stanford ..... E04H 17/16 256/27
4,101,226 A * 7/1978 Parisien ..... F16B 7/0446 403/4
4,289,302 A * 9/1981 Montgomery ..... E04H 17/20 256/65.11
4,477,059 A * 10/1984 Willis ..... E04H 17/1413 403/292
4,542,885 A 9/1985 Rossiter
4,553,741 A 11/1985 Creasy et al.
(Continued)

FOREIGN PATENT DOCUMENTS

DE 202012012273 U1 * 4/2013 ..... E04H 17/1404
EP 2807950 A1 12/2014
(Continued)

OTHER PUBLICATIONS

Office Action dated Oct. 4, 2023, issued in connection with Canadian Patent Application No. 3,156,266 (9 pages).

*Primary Examiner* — Jonathan P Masinick
(74) *Attorney, Agent, or Firm* — McCarter & English, LLP

(57) ABSTRACT

A fence system comprises a plurality of fence posts and a fence rail. The fence rail is characterized by a fence rail longitudinal axis and a fence rail cross-sectional profile in a plane orthogonal to the fence rail longitudinal axis. The fence rail cross-sectional profile has a hollow, obround shape. Each fence post has at least one rail opening having a substantially obround shape matching the obround shape of the cross-sectional profile of the fence rail, whereby a longitudinal end of the fence rail is slidingly insertable into the rail opening. The fence rail is mounted to and supported by a bracketing pair of the fence posts, wherein longitudinally opposing ends of the fence rail are positioned within corresponding rail openings of the bracketing pair of the fence posts.

20 Claims, 19 Drawing Sheets

(56) References Cited

U.S. PATENT DOCUMENTS 5,645,270 A * 7/1997 Lawrence ..... E04H 17/1447 256/22
5,857,664 A 1/1999 Schauman
6,499,725 B2 12/2002 Meis et al.
6,905,109 B2 6/2005 Mills
7,478,797 B2 * 1/2009 Laws ..... E04H 17/168 52/316
7,788,785 B2 9/2010 Platt
8,127,419 B2 * 3/2012 Calton ..... E04H 17/1413 29/402.09
8,561,371 B2 * 10/2013 Sanders ..... E04B 1/14 52/764
10,190,331 B2 * 1/2019 Delafield ..... B26F 1/40
10,760,299 B2 * 9/2020 Preston ..... E04H 17/168
11,268,294 B2 * 3/2022 Lindsay ..... E04F 11/1817
11,479,931 B2 * 10/2022 Wilson ..... E01F 8/0011
11,549,280 B1 * 1/2023 Walker ..... E04H 17/168
11,566,395 B2 * 1/2023 Cropper ..... E04H 17/00
2002/0179895 A1 12/2002 Bebendorf
2006/0273502 A1 * 12/2006 Sade ..... E04H 17/168 269/41
2007/0034846 A1 * 2/2007 Ratanasiriwilai ... E04H 17/1447 256/65.01
2008/0230761 A1 * 9/2008 Kuc ..... E04H 17/1465 256/65.14
2009/0152523 A1 * 6/2009 Erwin ..... E04H 17/1602 256/24
2009/0152524 A1 6/2009 Keller
2010/0193756 A1 * 8/2010 Buckley ..... E04H 17/1413 256/65.04
2010/0200825 A1 * 8/2010 Hill ..... E04H 17/16 256/24
2011/0024060 A1 * 2/2011 Brownbill ..... E04F 11/1842 160/188
2013/0328001 A1 12/2013 McCarthy et al.
2017/0058557 A1 * 3/2017 Wu ..... E04H 17/22
2017/0362825 A1 * 12/2017 Mann ..... E06B 7/082
2019/0024404 A1 * 1/2019 Dobson ..... B32B 15/16
2019/0284833 A1 * 9/2019 Yeh ..... E04H 17/1447
2019/0292809 A1 * 9/2019 Nelson ..... E04H 17/20

FOREIGN PATENT DOCUMENTS

FR 3003592 A1 * 9/2014 ..... E04H 17/163
FR 3035138 B1 * 4/2017 ..... A01N 25/00
FR 3059026 A1 * 5/2018 ..... A01K 1/0094
FR 3057886 B1 * 12/2018 ..... E04B 2/7453
KR 101147670 B1 * 5/2012
KR 101309180 B1 * 9/2013
KR 101440604 B1 * 9/2014

* cited by examiner

MODULAR FENCE

RELATED APPLICATIONS

This application claims priority under 35 U.S.C. § 119 to provisional application Ser. No. 63/177,642 filed Apr. 21, 2021, herein incorporated by reference in its entirety.

FIELD

The present disclosure relates generally to fence systems and in particular to modular fence systems.

BACKGROUND

Fences are widely used to enclose land areas to prevent or deter movement of people or animals into or out of an enclosed area.

Many fence systems are known, including basic fences assembled from wooden planks serving as fence rails which are affixed horizontally to a series of wooden fence posts driven, buried, or otherwise secured in or on the ground or other supporting surface. Often, the rails are affixed to the posts using nails or screws. In such case, disassembly of the fence is slow and cumbersome, and typically causes damage to the fence components. As such, conventional fence constructions are not optimally suited for temporary installations, where it is desired to be able quickly and easily to disassemble the fence system for transport and installation elsewhere without damage to the fence materials.

A variety of other fence systems have been developed for use in place of the conventional wooden post-and-plank system.

For example, U.S. Pat. No. 7,788,785 discloses a vinyl fence system involving the use of a rail clip assembly to connect a horizontal fence rail to a vertical fence post. The rail clip assembly includes a housing that is slidably engaged with a mounting spacer and a first leg of an L-shaped mounting bracket until a second leg of the bracket abuts the underside of the housing. A first fastener is screwed through the first leg and mounting spacer and into the side wall of the fence post. An end of the rail is inserted into the housing and a second fastener is screwed through the second leg, the housing and the end of the rail. The rail clip assembly aids in preventing the rail from disengaging from the housing when a lateral force is applied to the rail.

U.S. Pat. No. 4,542,885 discloses a metal fence post designed to receive wooden fence rails, and to support them within its openings, until the installer is ready to fasten the rails securely in place. The metal fence post consists of a metal channel, having side openings at various levels, for freely receiving fence rails. It further includes openings in its flanges, for receiving screws to fasten the rails therein.

U.S. Pat. No. 6,905,109 discloses plastic fences where rails are inserted into holes in hollow posts are which are effectively stiffened by inserting into the hollow post a stiffening device which grips the rails extending into the post, and which is stabilized against movement so as to prevent angular deflection of the rails with the posts in a plane orthogonal to the longitudinal axis of the post.

U.S. Pat. No. 4,553,741 discloses hollow plastic posts and rails interlock to form fences. The posts are hollow cylindrical pipes having two axially spaced elongated ovalur slots through the shell thereof for receiving the rails. The rails are hollow plastic members having ovalur ends for mating into the slots on the post. The members are interlocked by forming flexible deformable rail ends with a width slightly greater than the length of the receptacle slots and notching the rail ends to register in place engaging the shell casing of the posts at the ends of the slots.

U.S. Pat. No. 6,499,725 discloses a fence rail and post construction wherein a metal tubular fence rail has one end thereof extending through an opening formed in one side of the post. A rail retainer is selectively removably secured to the fence rail outwardly of the post with the retainer engaging the post to limit longitudinal movement of the fence rail with respect to the post.

United States Patent Application Publication No. 2009/0152524 discloses a fence stabilization system having a plurality of vertical fence support posts, each having hollow interiors extending the full length of each post. A column insert is positioned within each support post and extends substantially the length of the post. Each column insert is adjacent to, but spaced apart from the outer wall of the support post. The column insert has openings which are aligned with openings in the support post itself for the insertion of horizontal fence rail members into and through both the column insert and support post openings. Locking brackets with threaded connectors are located near the upper ends of the column insert and support post for securing horizontal rail members to the post. Threaded adjustment connectors are located near the lower ends of the column insert and support post to adjust the position of the column insert within the post and to secure the column insert position within the post.

European Patent Application Publication No. EP 2 807 950 A1 discloses a building system for fences comprising a hollow, elongated profile in the circumference of which at least one opening is made, a beam to be inserted through the opening into the profile, and a fitting piece that can slide along the length of the profile. The external form of the fitting piece fits with the internal form of the hollow profile, and it is shaped to at least partially grip around part of the beam inserted into the profile.

U.S. Pat. No. 5,857,664 discloses a fence system comprising tubular plastic posts and at least one tubular plastic rail, the rail having multiple rail sections joined together end-to-end with plastic couplings, and the posts each having an anchor assembly slidably-fitting into a bottom of the post and extending axially from the post so that the anchor assembly may be driven into the ground by aligning the post to the ground and driving the anchor assembly through the post and into the ground. Each post is provided with at least one rail aperture having an opening on one side of the post that is slightly larger than the rail sections and having an opening on the other side of the post that is vertically oblong so as to permit a rail section to extend through the rail opening at a non-perpendicular angle without binding in the aperture. The anchor assembly comprises three elongated plastic tubes arranged to nest together parallel to one another, each tube having a beveled end arranged with respect to the nested-together assembly to provide a ground-piercing end for the anchor assembly.

There remains a need, however, for improved modular fence systems including particularly for temporary installations where it is desirable to be able to uninstall and disassemble the fence system, transport it elsewhere, and reassemble and reinstall it at the new location.

BRIEF DESCRIPTION OF THE DRAWINGS

Embodiments will now be described, by way of example only, with reference to the attached Figures.

Figure 1:
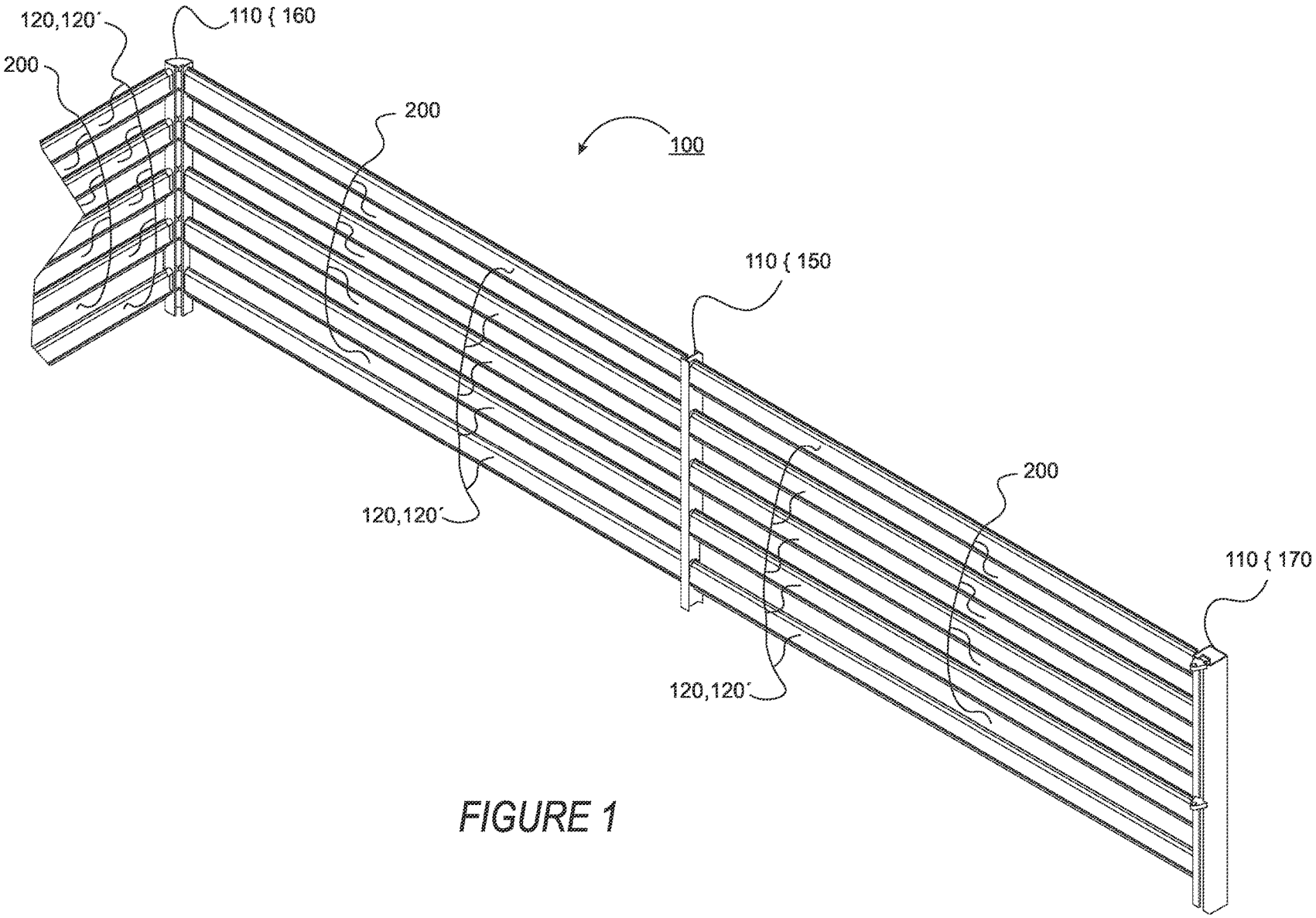
FIG. 1 shows a perspective view of a fence system.

Throughout the drawings, sometimes only one or fewer than all of the instances of an element visible in the view are designated by a lead line and reference character, for the sake only of simplicity and to avoid clutter. It will be understood, however, that in such cases, in accordance with the corresponding description, that all other instances are likewise designated and encompassed by the corresponding description.

DETAILED DESCRIPTION

A modular fence system and fence construction method are disclosed herein. The modular fence system enables the rapid in-place construction and installation of a fence using modular components without the requirement of fasteners or specialized tools. The fence system is easily disassembled without damage to any of the fence system components. The fence system design permits expansion and contraction of the fence system components resulting from environmental temperature fluctuations. The fence system design is adaptable to provide either an open configuration with spacing between fence rails to permit the free passage of light and air, or a closed configuration providing an entirely closed, substantially continuous barrier, or intermediate configurations between the foregoing.

A fence system 100 is shown in FIG. 1. The fence system 100 has a plurality of fence posts 110 and a plurality of fence rails 120,120'. The fence system 100 may be considered to have a number of sections, with each section having a corresponding pair of the fence posts 110 bracketing and supporting a number of the fence rails 120,120', as described and shown below. In the embodiment shown in FIG. 1, five fence rails 120,120' are shown in each section of the fence system 100, although any number of fence rails 120,120' is possible. Three different types of fence posts 110 are shown, namely a middle fence post 150, a corner fence post 160, and an end fence post 170. The fence rails 120,120' in each section may be supported by the corresponding bracketing fence posts 110 so as to be substantially horizontally parallel to each other, and commonly substantially perpendicular to the fence posts 110. As will be discussed below, the fence posts 110 and fence rails 120,120' may be sized, shaped, and configured such that once the fence system 100 is assembled, at least some movement of the fence posts 110 and fence rails 120,120' relative to one another is permitted, and this may include at least some amount of variation of the horizontal parallelism of the fence rails 120,120' and at least some amount of variation of the perpendicularity of the fence rails 120,120' relative to the fence posts 110.

Figure 2:
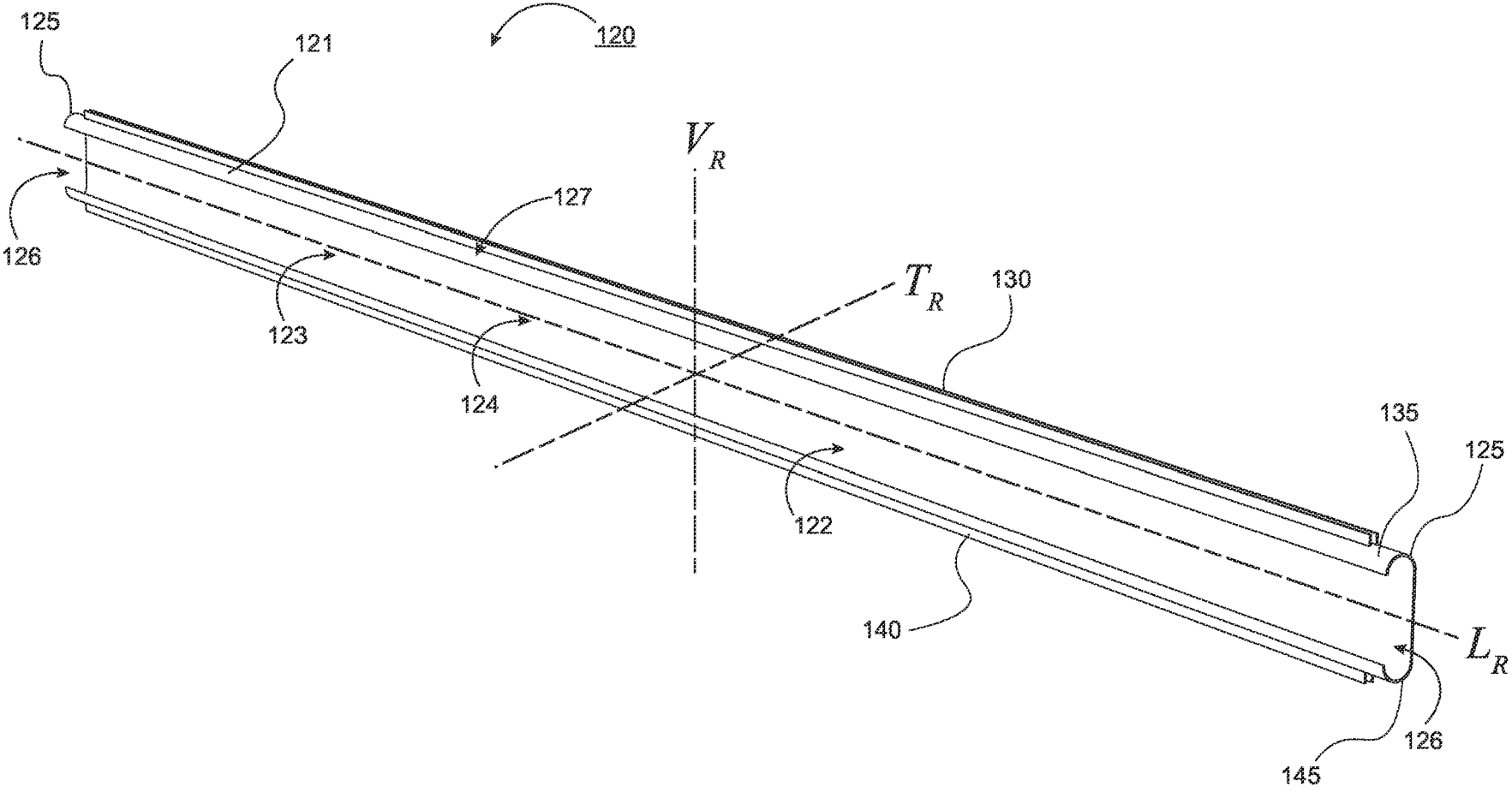
FIG. 2 shows a perspective view of a male fence rail.
Figure 3:
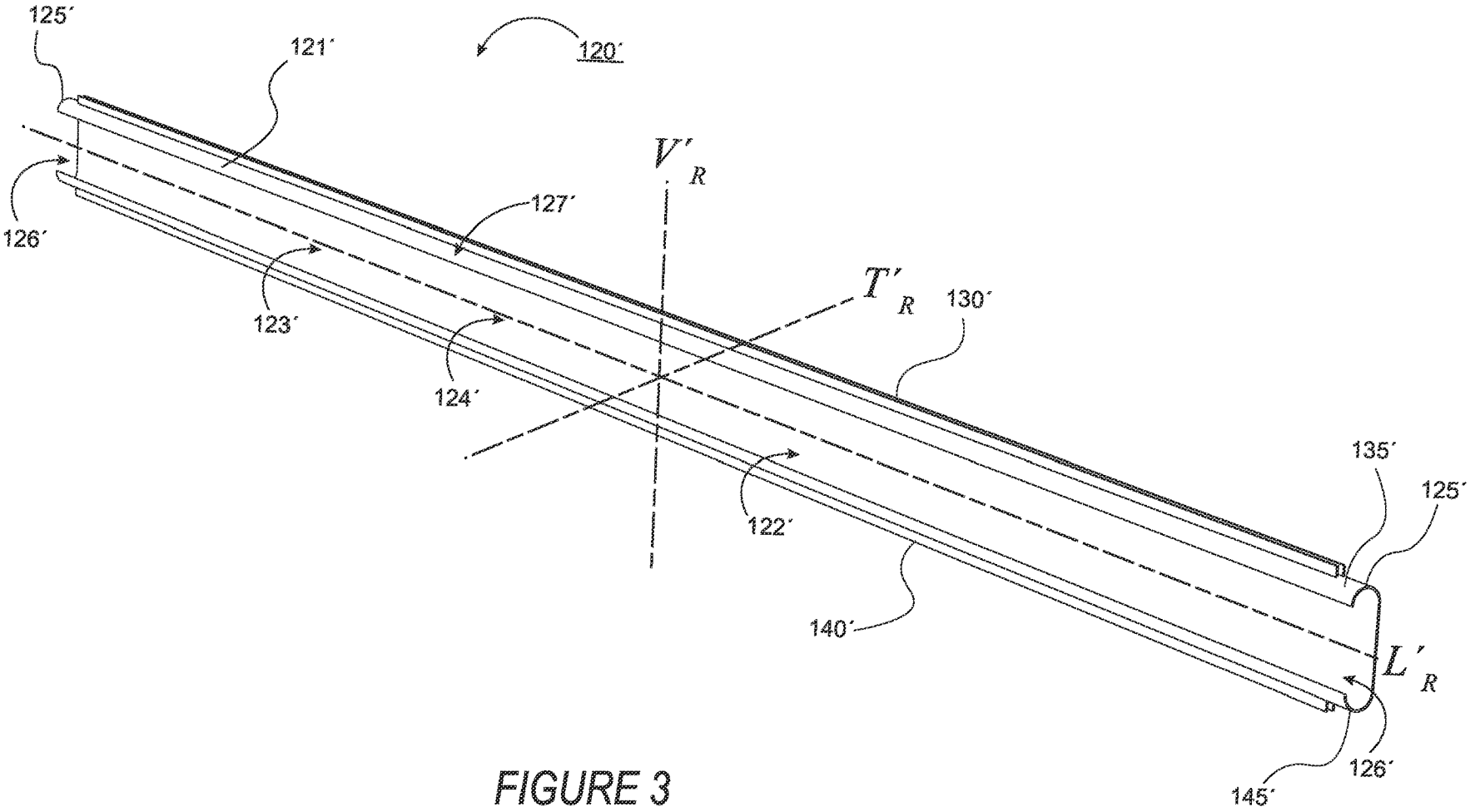
FIG. 3 shows a perspective view of a female fence rail.
Figure 4:
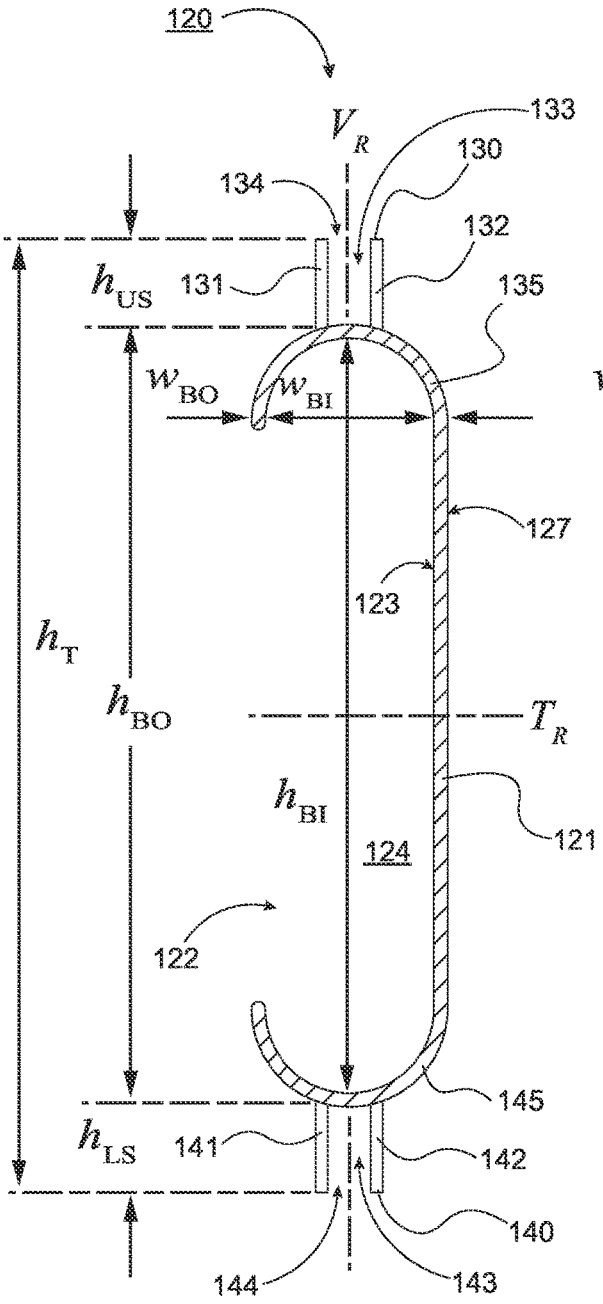
FIG. 4 shows a transverse cross-sectional view of the male fence rail of FIG. 2.
Figure 5:
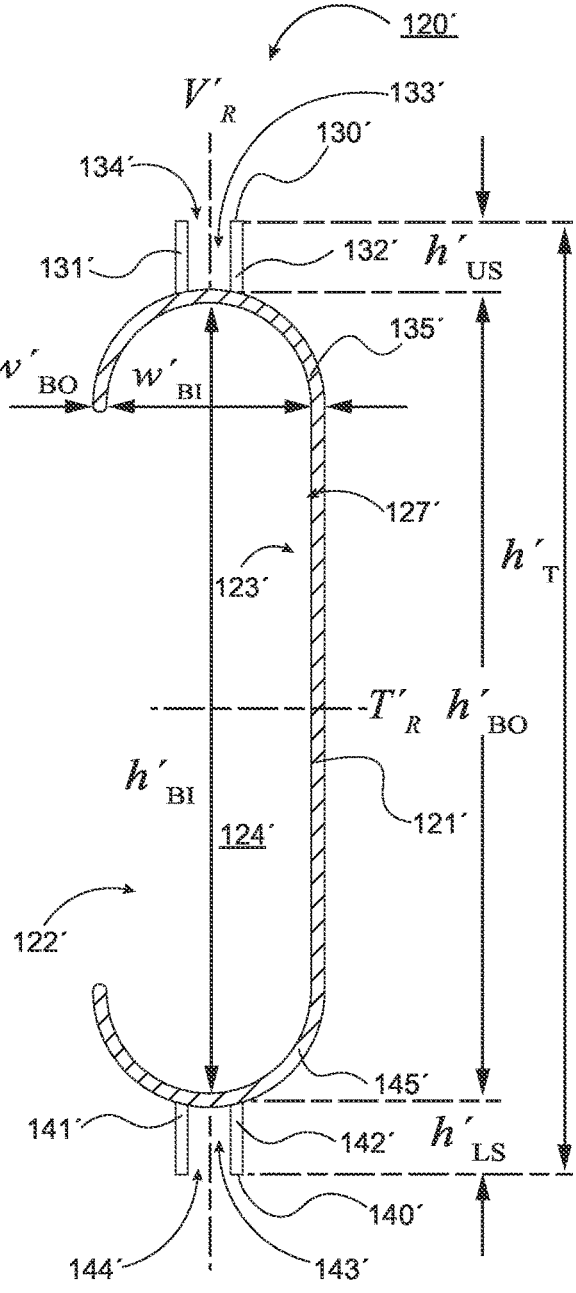
FIG. 5 shows a transverse cross-sectional view of the female fence rail of FIG. 3.

FIGS. 2 to 5 show fence rails 120,120' of the fence system 100. In particular, FIGS. 2 & 4 show a male fence rail 120 and FIGS. 3 & 5 show a female fence rail 120'. The male fence rail 120 has a longitudinally extended body 121 and may be characterized by a longitudinal axis $L_R$, a transverse axis $T_R$, and a vertical axis $V_R$, which are mutually orthogonal. Similarly, the female fence rail 120' has a longitudinally extended body 121' and may be characterized by a longitudinal axis $L'_R$, a transverse axis $T'_R$, and a vertical axis $V'_R$ which are mutually orthogonal.

As shown particularly in FIG. 4, a cross-sectional profile of the main body 121 of male fence rail 120 orthogonal to the longitudinal axis $L_R$ thereof may have an open, hollow, substantially geometric stadium, or obround, shape, consisting of two semicircles connected by parallel lines tangent to the endpoints of the semicircles, except where one of the two parallel lines is omitted or shortened so as to form a side opening 122 extending along the length of the fence rail 120. To put it another way, the cross-sectional profile of the main body 121 may have the shape of two semi-circles where open sides of the two semi-circles are opposing with pairs of opposing ends and where only one pair of opposing ends is connected by a line, and the other pair of opposing ends is not connected by a line. The main body 121 of the male fence rail 120 has an outer surface 127 and an inner surface 123, wherein the inner surface 123 partly bounds an interior hollow 124 of the male fence rail 120, open to the exterior by way of the side opening 122. The male fence rail 120 further has longitudinally opposite ends 125 each of which forms an opening 126 having a generally geometric stadium or obround shape, that is formed of two opposing and spaced semicircles bridged by a rectangle.

Similarly, and as shown particularly in FIG. 5, a cross-sectional profile of the main body 121' of female fence rail 120' orthogonal to the longitudinal axis $L'_R$ thereof may have an open, hollow, substantially geometric stadium, or obround, shape, consisting of two semicircles connected by parallel lines tangent to the endpoints of the semicircles, except where one of the two parallel lines is omitted or shortened so as to form a side opening 122' extending along the length of the female fence rail 120'. To put it another way, the cross-sectional profile of the main body 121' may have the shape of two semi-circles where open sides of the two semi-circles are opposing with pairs of opposing ends and where only one pair of opposing ends is connected by a line, and the other pair of opposing ends is not connected by a line. The main body 121' of the female fence rail 120' has an outer surface 127' and inner surface 123', wherein the inner surface 123' partly bounds an interior hollow 124' of the female fence rail 120', open to the exterior by way of the side opening 122'. The female fence rail 120' further has longitudinally opposite ends 125' each of which forms an opening 126' having a generally geometric stadium or obround shape, that is formed of two opposing and spaced semicircles bridged by a rectangle.

The male fence rail 120 and the female fence rail 120' may be so relatively sized, shaped, and configured, such that male fence rail 120 and female fence rail 120' may be aligned longitudinally, such that their respective longitudinal axes $L_R$,$L'_R$ are coincident, with a longitudinal end 125 of the male fence rail 120 opposing an end opening 126' of the female fence rail 120', and by relative longitudinal motion of the male fence rail 120 and the female fence rail 120' together, the longitudinal end 125 of the male fence rail 120 may be slidingly and fittingly inserted into the end opening 126' of the female fence rail 120', thereby to longitudinally mate the male fence rail 120 with the female fence rail 120'. In particular, the main body 121 of the male fence rail 120 and the main body 121' of the female fence rail 120' may be respectively so sized, shaped, and configured such that the respective cross-sectional profiles of the male fence rail 120 and the female fence rail 120' match, or in other words such that an outer surface 127 of the main body 121 of the male fence rail 120 matches and is slightly smaller than an inner surface 123' of the main body 121' of the female fence rail 120'.

A spacing or tolerance between the outer surface 127 of the male fence rail 120 and the inner surface 123' of the female fence rail 120' may be preconfigured such that the longitudinal end 125 of the male fence rail 120 is slidingly and fittingly insertable into the end opening 126' of the female fence rail 120' with a preconfigured degree of frictional sliding resistance. The preconfigured degree of frictional sliding resistance may be such as to achieve a particular functional effect, which may include to permit ready and easy manual mating of the male fence rail 120 and the female fence rail 120', as described, while resisting relative longitudinal motion of, including unmating of, the male fence rail 120 and the female fence rail 120' absent a threshold longitudinal separation force. As indicated above, the components of the fence system 100 may be so sized, shaped, and configured to permit at least some relative movement to accommodate for expansion and contraction experienced as a result of temperature fluctuations. The described spacing or tolerance of the male fence rail 120 and the female fence rail 120' may be preconfigured to permit such temperature-related relative movement, while also providing sufficient frictional sliding resistance to prevent or resist relative longitudinal movement and unmating of the male fence rail 120 and female fence rail 120' once mated. For example, in some embodiments a spacing or tolerance between the outer surface 127 of the male fence rail 120 and the inner surface 123' of the female fence rail 120' may be from about 0.01 mm to about 2 mm, or about 1.6 mm. A different spacing or tolerance is possible and contemplated.

The male fence rail 120 may have an upper panel slot 130 and a lower panel slot 140. The upper panel slot 130 may have a pair of flanges 131,132 projecting upwardly along the vertical axis $V_R$ from the outer surface 127 at an upper side 135 of the male fence rail 120 and extending along the longitudinal axis $L_R$. The pair of flanges 131,132 may oppose transversely along the transverse axis $T_R$ to form a channel 133 therebetween with an opening 134, each of which also extends along the longitudinal axis $L_R$. Similarly, the lower panel slot 140 may have a pair of flanges 141,142 projecting downwardly along the vertical axis $V_R$ from the outer surface 127 at a lower side 145 of the male fence rail 120 and extending along the longitudinal axis $L_R$. The pair of flanges 141,142 may oppose transversely along the transverse axis $T_R$ to form a channel 143 therebetween with an opening 144, each of which also extends along the longitudinal axis $L_R$. The flanges 131,132 of the upper panel slot 130 and consequently the channel 133 formed therebetween may have a height $h_{US}$, and the flanges 141,142 of the lower panel slot 140 and consequently the channel 143 formed therebetween may have a height $h_{LS}$. The height $h_{US}$ of the upper panel slot 130 and the height $h_{LS}$ of the lower panel slot 140 may be the same or different. The main body 121 may have an outside height $h_{BO}$ and an outside width $w_{BO}$, and the interior hollow 124 of the main body 121 may have an inside height $h_{BI}$ and an inside width $w_{BI}$. The male fence rail 120 including the upper panel slot 130 and the lower panel slot 140 may have a total height of $h_T$.

Similarly, the female fence rail 120' may have an upper panel slot 130' and a lower panel slot 140'. The upper panel slot 130' may have a pair of flanges 131',132' projecting upwardly along the vertical axis $V'_R$ from the outer surface 127' at an upper side 135' of the female fence rail 120' and extending along the longitudinal axis $L'_R$. The pair of flanges 131',132' may oppose transversely along the transverse axis $T'_R$ to form a channel 133' therebetween with an opening 134', each of which also extends along the longitudinal axis $L'_R$. Similarly, the lower panel slot 140' may have a pair of flanges 141',142' projecting downwardly along the vertical axis $V'_R$ from the outer surface 127' at a lower side 145' of the female fence rail 120' and extending along the longitudinal axis $L'_R$. The pair of flanges 141',142' may oppose transversely along the transverse axis $T'_R$ to form a channel 143' therebetween with an opening 144', each of which also extends along the longitudinal axis $L'_R$. The flanges 131', 132' of the upper panel slot 130' and consequently the channel 133' formed therebetween may have a height $h'_{US}$, and the flanges 141',142' of the lower panel slot 140' and consequently the channel 143' formed therebetween may have a height $h'_{LS}$. The height $h'_{US}$ of the upper panel slot 130' and the height $h'_{LS}$ of the lower panel slot 140' may be the same or different. The main body 121' may have an outside height $h'_{BO}$ and an outside width $w'_{BO}$, and the interior hollow 124' of the main body 121' may have an inside height $h'_{BI}$ and an inside width $w'_{BI}$. The female fence rail 120' including the upper panel slot 130' and the lower panel slot 140' may have a total height of $h'_T$.

As described above, the male fence rail 120 and the female fence rail 120' are respectively sized and shaped for longitudinal mating thereof. As such, the outside height $h_{BO}$ of the main body 121 of the male fence rail 120 may be less than the inside height $h'_{BI}$ of the main body 121' of the female fence rail 120'. The height $h_{US}$ of the upper panel slot 130 of the male fence rail 120 may be the same as or different from the height $h'_{US}$ of the upper panel slot 130' of the female fence rail 120'. Similarly, the height $h_{LS}$ of the lower panel slot 140 of the male fence rail 120 may be the same as or different from the height $h'_{LS}$ of the lower panel slot 140' of the female fence rail 120'. Similarly, the total height $h_T$ of the male fence rail 120 may the same or different from the total height $h'_T$ of the female fence rail 120'. It will be appreciated that when the total height $h_T$ of the male fence rail 120 is the same as the total height $h'_T$ of the female fence rail 120', a sum of the height $h_{US}$ of the upper panel slot 130 and the height $h_{LS}$ of the lower panel slot 140 of the male fence rail 120 must be greater than a sum of the height $h'_{US}$ of the upper panel slot 130' and the height $h'_{LS}$ of the lower panel slot 140' of the female fence rail 120', when the outside height $h_{BO}$ of the main body 121 of the male fence rail 120 is less than the inside height $h'_{BI}$ of the main body 121' of the female fence rail 120'. Thus, a careful inspection of FIGS. 4 & 5 illustrates that, in the embodiments shown, the upper panel slot 130 height $h_{US}$ and lower panel slot 140 height $h_{US}$ LS of the male fence rail 120 are respectively greater than the upper panel slot 130' height $h'_{US}$ and the lower panel slot 140' height $h'_{LS}$ of the female fence rail 120'. Other configurations are possible.

Each of the upper panel slot 130 and lower panel slot 140 of the male fence rail 120 may extend an entire length of the male fence rail 120, or less than an entire length of the male fence rail 120 such that respective ends of the upper panel slot 130 and lower panel slot 140 are spaced from the corresponding adjacent longitudinal ends 125 of the male fence rail 120. Similarly, each of the upper panel slot 130' and lower panel slot 140' of the female fence rail 120' may extend an entire length of the female fence rail 120', or less than an entire length of the female fence rail 120' such that respective ends of the upper panel slot 130' and lower panel slot 140' are spaced from the corresponding adjacent longitudinal ends 125' of the female fence rail 120'.

Figure 6:
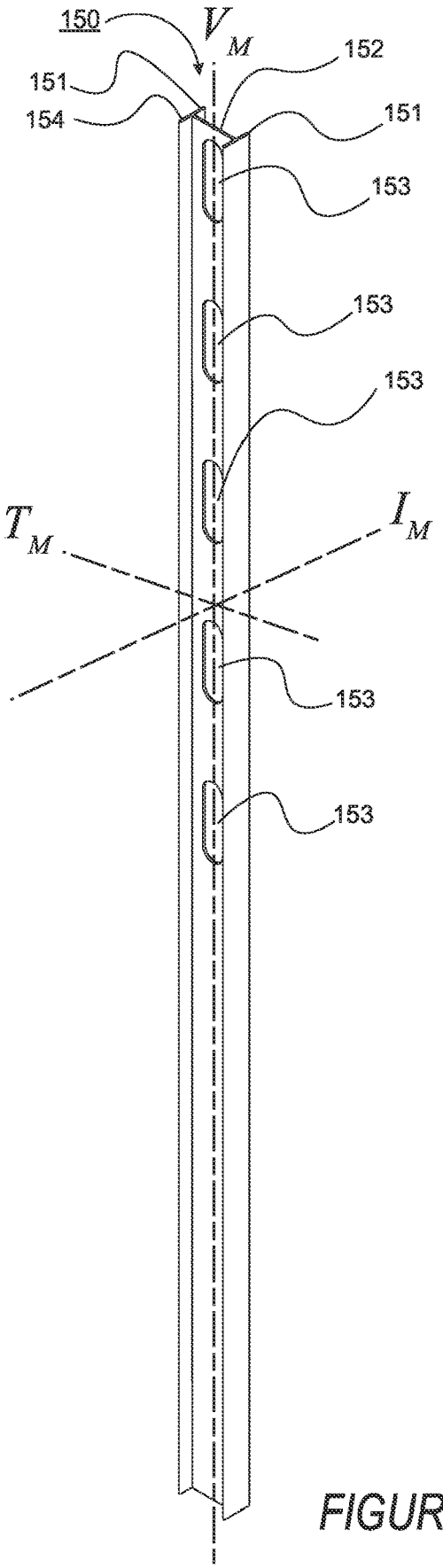
FIG. 6 shows a perspective view of a middle fence post.
Figure 7:
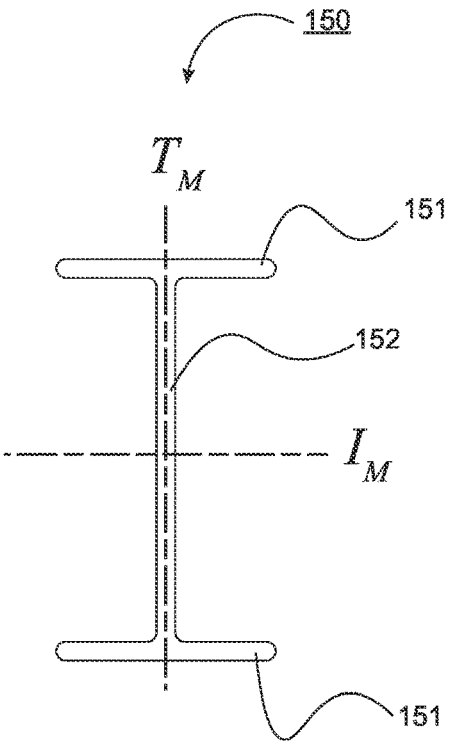
FIG. 7 shows a transverse cross-sectional view of the middle fence post of FIG. 6.
Figure 8:
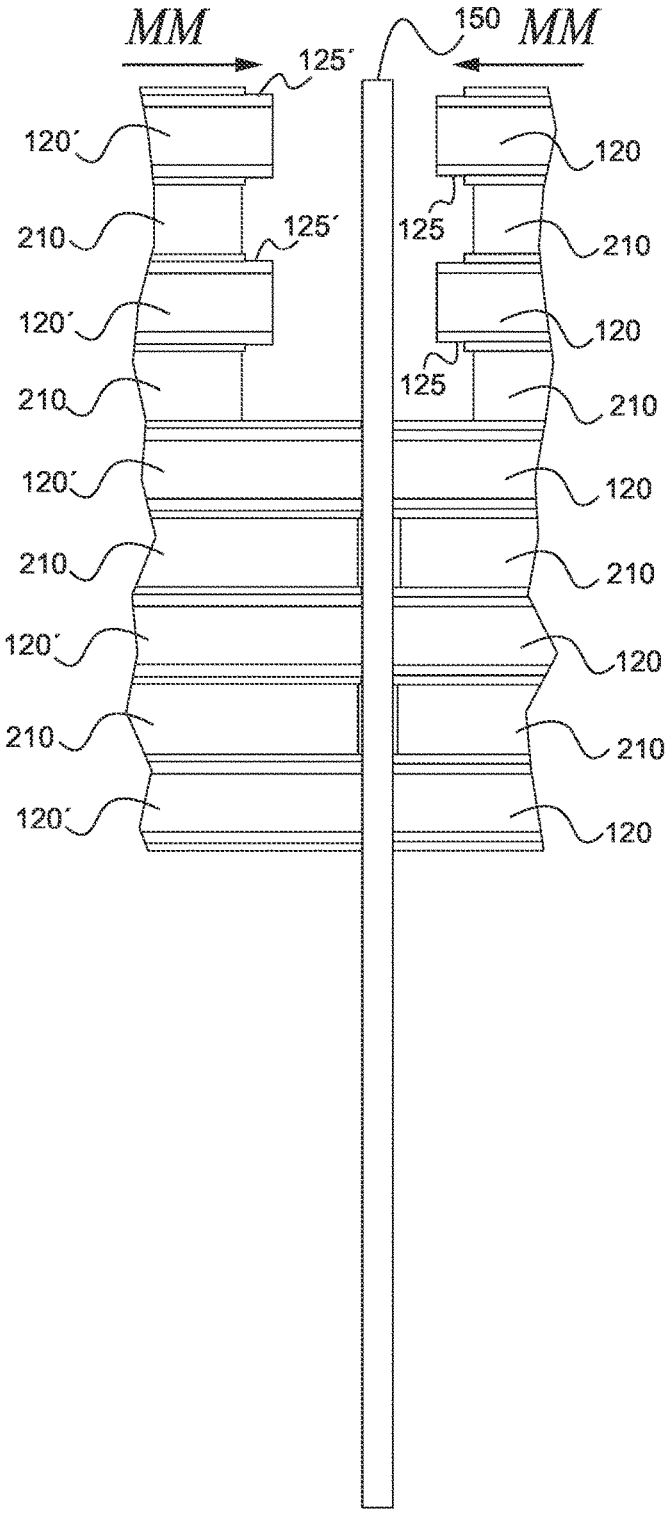
FIGS. 8-13 show views of an assembly of male fence rails of FIG. 2 and female fence rails of FIG. 3 with the middle fence post of FIG. 6, and also with panels.
Figure 9:
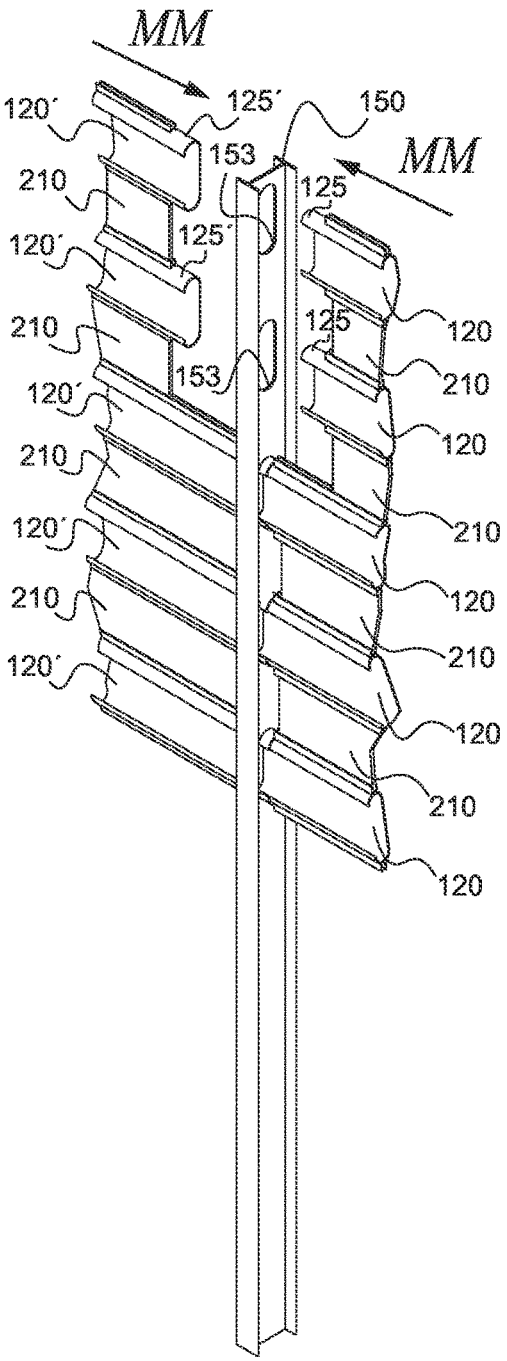
Figure 10:
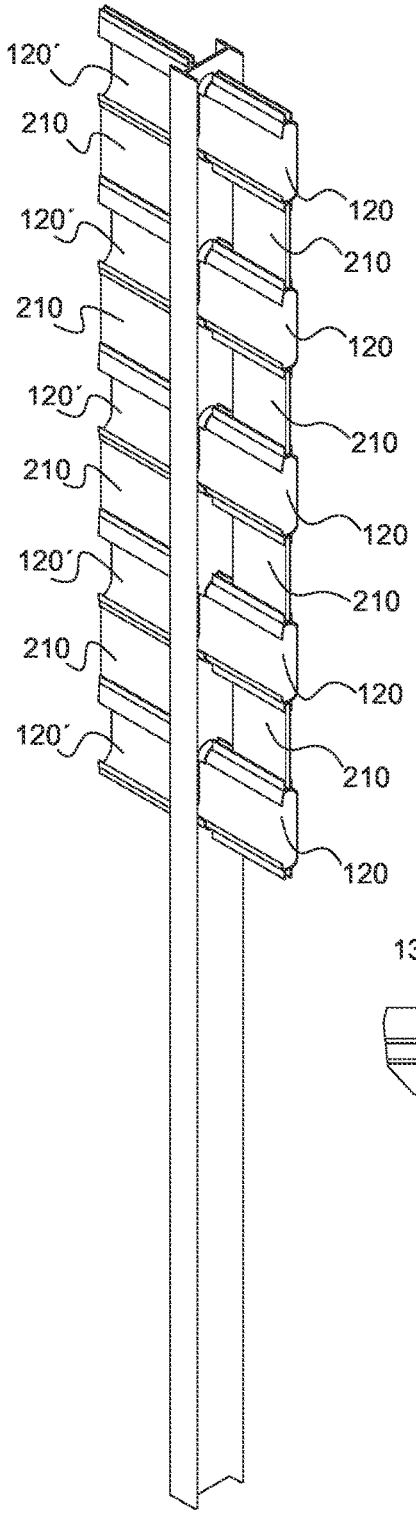
Figure 11:
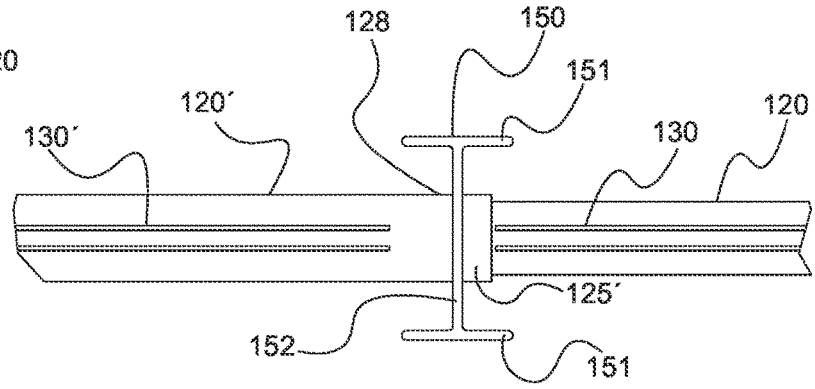
Figure 12:
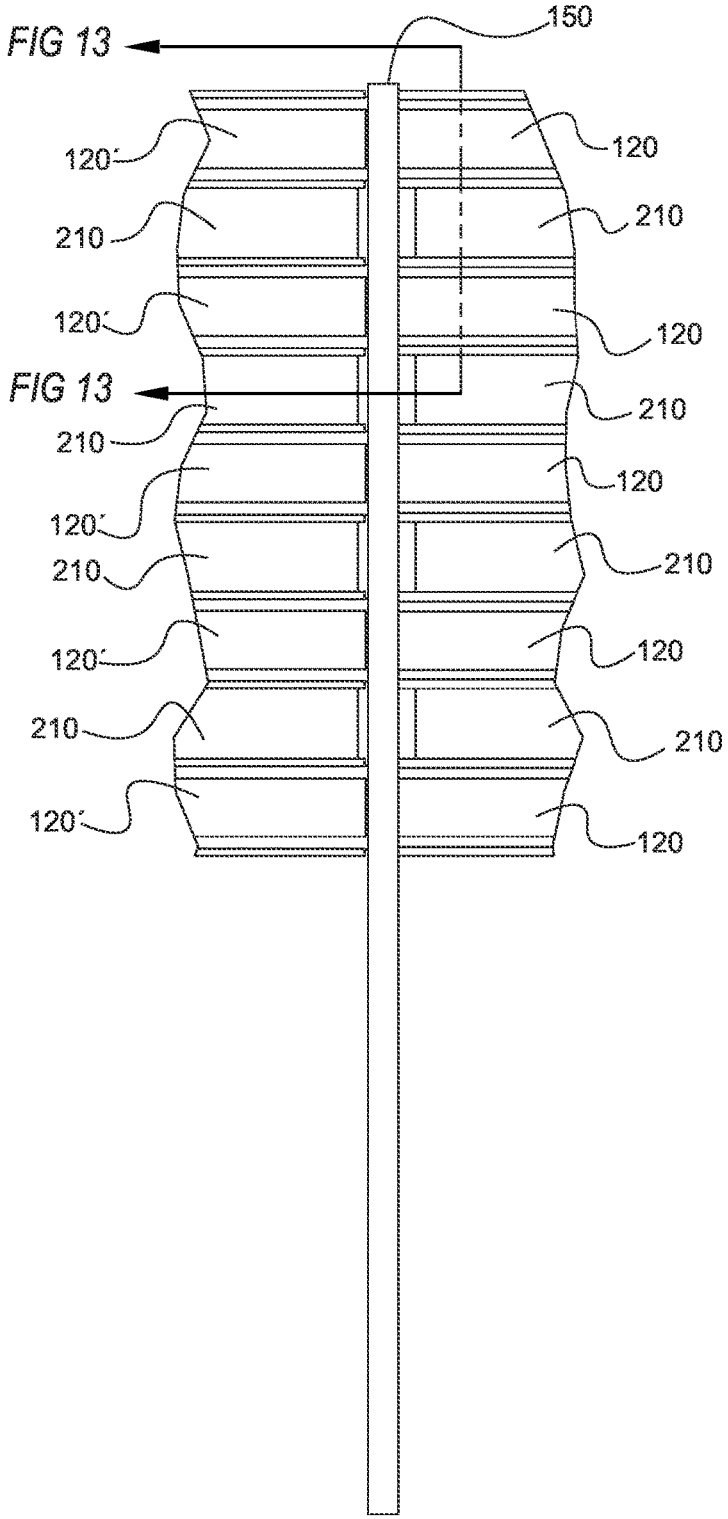
Figure 13:
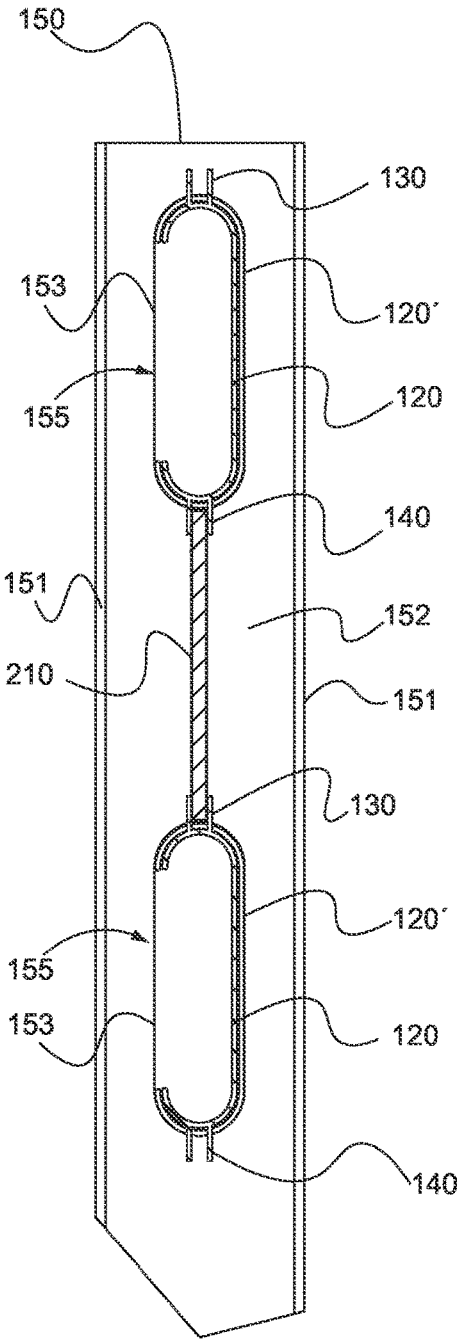

FIGS. 6 & 7 show a middle fence post 150 of the fence system 100. The middle fence post 150 may be characterized by a vertical axis $V_M$, an insertion axis $I_M$, and a transverse axis $T_M$ which are all mutually orthogonal. The middle fence post 150 may be further characterized by a horizontal cross-section in the plane of the insertion axis $I_M$ and the transverse axis $T_M$, and a vertical cross-section in the plane of the vertical axis $V_M$ and the transverse axis $T_M$. As shown particularly in FIG. 7, the horizontal cross-sectional profile of the middle fence post 150 may be in the shape of an I, and thus the middle fence post 150 may have substantially the shape of an I-beam, having two parallel flanges 151 bridged by a perpendicular web 152. The web 152 may be formed with at least one rail opening 153. When the web 152 has multiple rail openings 153, they may be spaced along the vertical axis $V_M$ of the middle fence post 150, with a vertically uppermost rail opening 153 proximal an upper end 154 of the middle fence post 150. The vertical spacing of the rail openings 153 may be equal or unequal with respect to one or more pairs of adjacent rail openings 153. Each rail opening 153 may have a substantially stadium, or obround, shape, and may have a size and shape which is substantially the same, nearly the same, or similar to the outer surface 127' of the main body 121' of the female fence rail 120' at a longitudinal end 125' thereof.

Assembly of the middle fence post 140 and fence rails 120,121' described above to form a portion of the fence system 100 is shown in FIGS. 8 through 13. Before or after the middle fence post 150 is planted or otherwise secured in the ground or other surface onto which the fence system 100 is to be installed, pairs of opposing fence rails 120,120' may be positioned and aligned longitudinally, and further aligned with a corresponding one of the rail openings 153 of the middle fence post 150. For each pair of the opposing fence rails 120,120', one may be a male fence rail 120 and the other may be a female fence rail 120'. While in the embodiment shown there are all female fence rails 120' on one side of the middle fence post 150 and all male fence rails 120 on the other side of the middle fence post 150, other arrangements are possible so long as for a given corresponding rail opening 153, a female fence rail 120' is on one side of the middle fence post 150 and a male fence rail 120 is on the opposite side thereof. When so arranged and positioned, the pair of opposing fence rails 120,120' may then be longitudinally moved together relatively as illustrated by arrows MM so as to mate the male fence rail 120 and the female fence rail 120' as described above, such that an overlapping portion 128 of the mated male fence rail 120 and female fence rail 120' is positioned within the corresponding rail opening 153 of the middle fence post 150. In some embodiments, the overlapping portion 128 may have a length of about 2 cm to about 20 cm. Other lengths are possible and contemplated.

As noted above, each rail opening 153 may have a substantially stadium, or obround, shape, and may have a size and shape which is substantially the same, nearly the same, or similar to the outer surface 127' of the main body 121' of the female fence rail 120' at a longitudinal end 125' thereof. Thus, vertical and horizontal dimensions of the rail openings 153 extending respectively along the vertical axis $V_M$ and the transverse axis $T_M$ may be substantially similar to, or slightly greater than, the outside height $h'_{BO}$ and outside width $w'_{BO}$, of the female fence rail 120' main body 121'. In particular, a spacing or tolerance between the outer surface 127' of the female fence rail 120' and an inner boundary 155 of the rail opening 153 may be preconfigured such that the longitudinal end 125' of the female fence rail 120' is slidingly and fittingly insertable into the rail opening 153 with a preconfigured degree of frictional sliding resistance. The preconfigured degree of frictional sliding resistance may be such as to achieve a particular functional effect, which may include to permit ready and easy manual insertion of the female fence rail 120' as described, while resisting relative motion of, including sliding removal of, the female fence rail 120' from the rail opening 153 absent a threshold separation force. As indicated above, the components of the fence system 100 may be so sized, shaped, and configured to permit at least some relative movement to accommodate for expansion and contraction experienced as a result of temperature fluctuations. The described spacing or tolerance of the female fence rail 120' and the rail opening 153 may be preconfigured to permit such temperature-related relative movement, while also providing sufficient frictional sliding resistance to prevent or resist relative longitudinal movement and removal of the female fence rail 120' and rail opening 153 once the female fence rail 120' is inserted in the rail opening 153 as described.

As discussed above, each of the upper panel slot 130 and the lower panel slot 140 of the male fence rail 120, on the one hand, and the upper panel slot 130' and the lower panel slot 140' of the female fence rail 120', on the other hand, may extend less than an entire length of the male fence rail 120 and the female fence rail 120', respectively, such that respective ends of the upper panel slots 130,130' and the lower panel slots 140,140' are spaced from the corresponding adjacent longitudinal ends 125,125' of the male fence rail 120 and the female fence rail 120'. Such a configuration enables mating insertion of the longitudinal end 125 of the male fence rail 120 into the open end 126' of the female fence rail 120' as described, and moreover enables insertion of the longitudinal end 125' of the female fence rail 120' into the rail opening 153 of the middle fence post 150, without requiring the provision of additional slots to receive the respective ends of the upper panel slots 130,130' and the lower panel slots 140,140' were they to extend an entire length of the male fence rail 120 or female fence rail 120'. Such an alternative configuration is possible and contemplated, however, wherein the female fence rail 120' and the rail openings 153 are each provided with additional slots (not shown) sized, shaped, and configured to slidingly receive the flanges 131,132 of the upper panel slots 130 and the flanges 141,142 of the lower panel slots 140 of the male fence rail 120, on the one hand, and the flanges 131',132' of the upper panel slots 130' and the flanges 141',142' of the lower panel slots 140' of the female fence rail 120', on the other hand.

While the above procedure is shown and described with respect to one pair of the fence rails 120,120' in cooperation with one of the middle fence post 150 rail openings 153, it will be understood that the same procedure is performable with further fence rails 120,120' and rail openings 153 in the middle fence post 150 to form a portion of the fence system 100.

In the embodiments described above, a male fence rail 120 is mated with a female fence rail 120' in assembly with a middle fence post 150 involving positioning of an overlapping portion 128 of the mated male fence rail 120 and the female fence rail 120' in a rail opening 153 of the middle fence post 150. As also described above, the rail opening 153 and female fence rail 120' a respectively sized, shaped, and configured for fitting insertion of the longitudinal end 125' of the female fence rail 120' into the rail opening 153 with a degree of frictional sliding resistance may be such as to achieve a particular functional effect.

In other embodiments, two longitudinally opposing male fence rails 120 may be mated longitudinally by means of a rail adapter sleeve 180. As described below, the rail adapter sleeve 180 may be a hollow obround right prism sized and shaped such that a longitudinal end 125 of one of the male fence rails 120 may be slidingly inserted into an end opening of the rail adapter sleeve 180. In particular, the rail adapter sleeve 180 may be substantially similar to the main body 121' of the female fence rail 120', instead having a relatively short longitudinal length along the longitudinal axis $L'_R$ thereof. In other words, the rail adapter sleeve 180 may likewise be characterized by the outside height $h'_{BO}$, outside width $w'_{BO}$, inside height $h'_{BI}$, and inside width $w'_{BI}$ of the female fence rail 120'. The result may be that the combination of the rail adapter sleeve 180 and the longitudinal end 125 of the male fence rail 120 functions substantially as a longitudinal end 125' of a female fence rail 120' as described above, i.e. the other male fence rail 120 may be longitudinally mated with the assembled rail adapter sleeve 180 and opposing male fence rail 120, in substantially the same manner as described above with respect to a longitudinally opposing female fence rail 120'. In a substantially similar way, two female fence rails 120' may be longitudinally mated through the use of a rail adapter plug (not shown) which may be a hollow or solid obround prism similar to the main body 121 of the male fence rail 120 having a relatively short longitudinal length along the longitudinal axis $L_R$ thereof, and similarly characterized by the outside height $h_{BO}$ and an outside width $w_{BO}$ thereof, where each female fence rail 120' slidingly receives in an end opening 126' thereof an opposing end of the rail adapter plug. Thus, by use of the rail adapter sleeve and rail adapter plug, any desired combination of male fence rails 120 and female fence rails 120' may be used to construct a section of the fence system 100.

Figure 14:
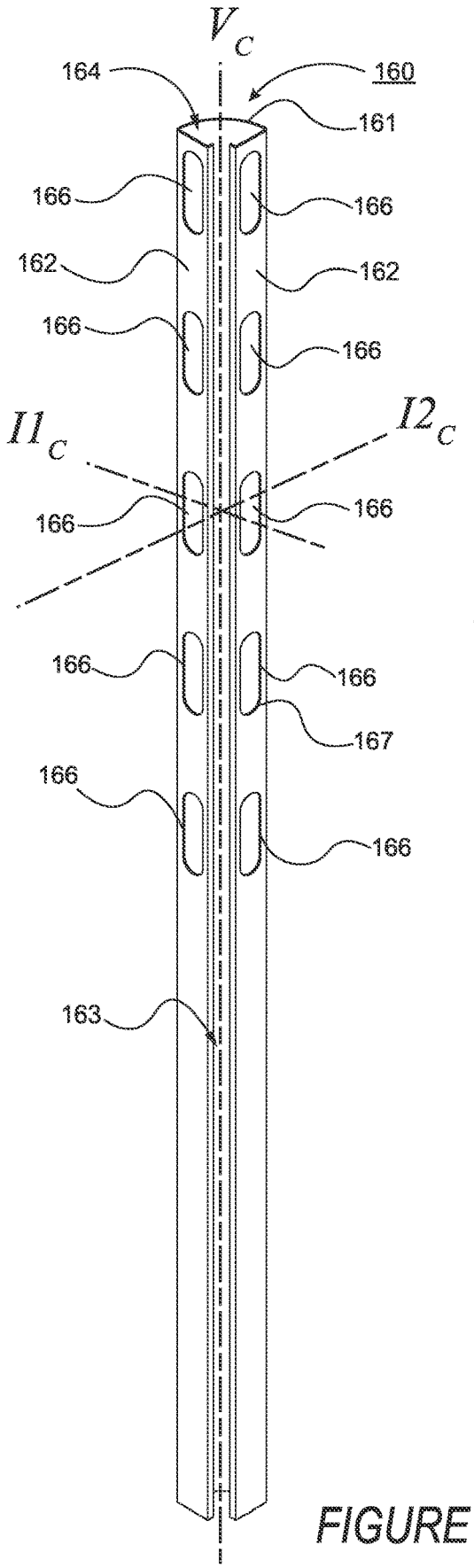
FIG. 14 shows a perspective view of a corner fence post.
Figure 15:
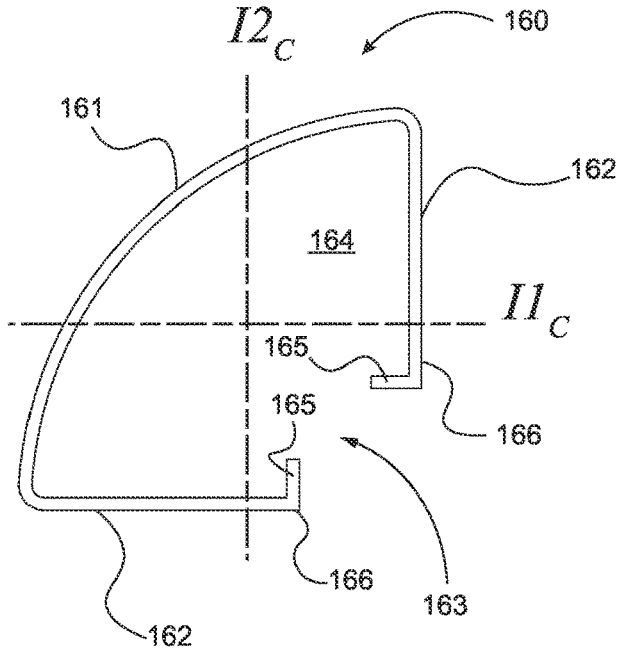
FIG. 15 shows a transverse cross-sectional view of the corner fence post of FIG. 14.

FIGS. 14 & 15 show a corner fence post 160 of the fence system 100. The corner fence post 160 may be characterized by a vertical axis $V_C$, a first insertion axis $I1_C$, and a second insertion axis $I2_C$, which are mutually orthogonal. As shown particularly in FIG. 15, the cross-sectional profile of the corner fence post 160 in the plane of the first insertion axis $I1_C$ and the second insertion axis $I2_C$ may be in the shape of a hollow quarter-circle, or quadrant, with an opening or slot 163 along at or about a radial center of the quarter-circle. Thus, the corner fence post 160 has a quarter-circular wall 161 joined at each longitudinal edge to a rectangular radial wall 162 extending radially partway to a radial center of the quarter-circle of the cross-sectional profile. As such, the opposing rectangular radial walls 162 form a slot 163, and the quarter-circular wall 161 and rectangular radial walls 162 form a channel 164, each of which may extend an entire length of the corner fence post 160. The corner fence post 160 may further have opposing rectangular ridges 165 each extending from a corresponding longitudinal edge 166 of one of the rectangular radial walls 162, perpendicularly from the corresponding rectangular radial wall 162 into the channel 164. One or both of the rectangular radial walls 162 may be formed with at least one rail opening 166. When a rectangular radial wall 162 has multiple rail openings 166, they may be spaced along the vertical axis $V_C$ of the rectangular radial wall 162, which spacing may be equal or unequal with respect to one or more pairs of adjacent rail openings 166. Each rail opening 166 may have a substantially stadium, or obround, shape, and may have a size and shape which is substantially the same, nearly the same, or similar to an outer surface 127' of the main body 121' of the female fence rail 120' at a longitudinal end 125' thereof.

Figure 16:
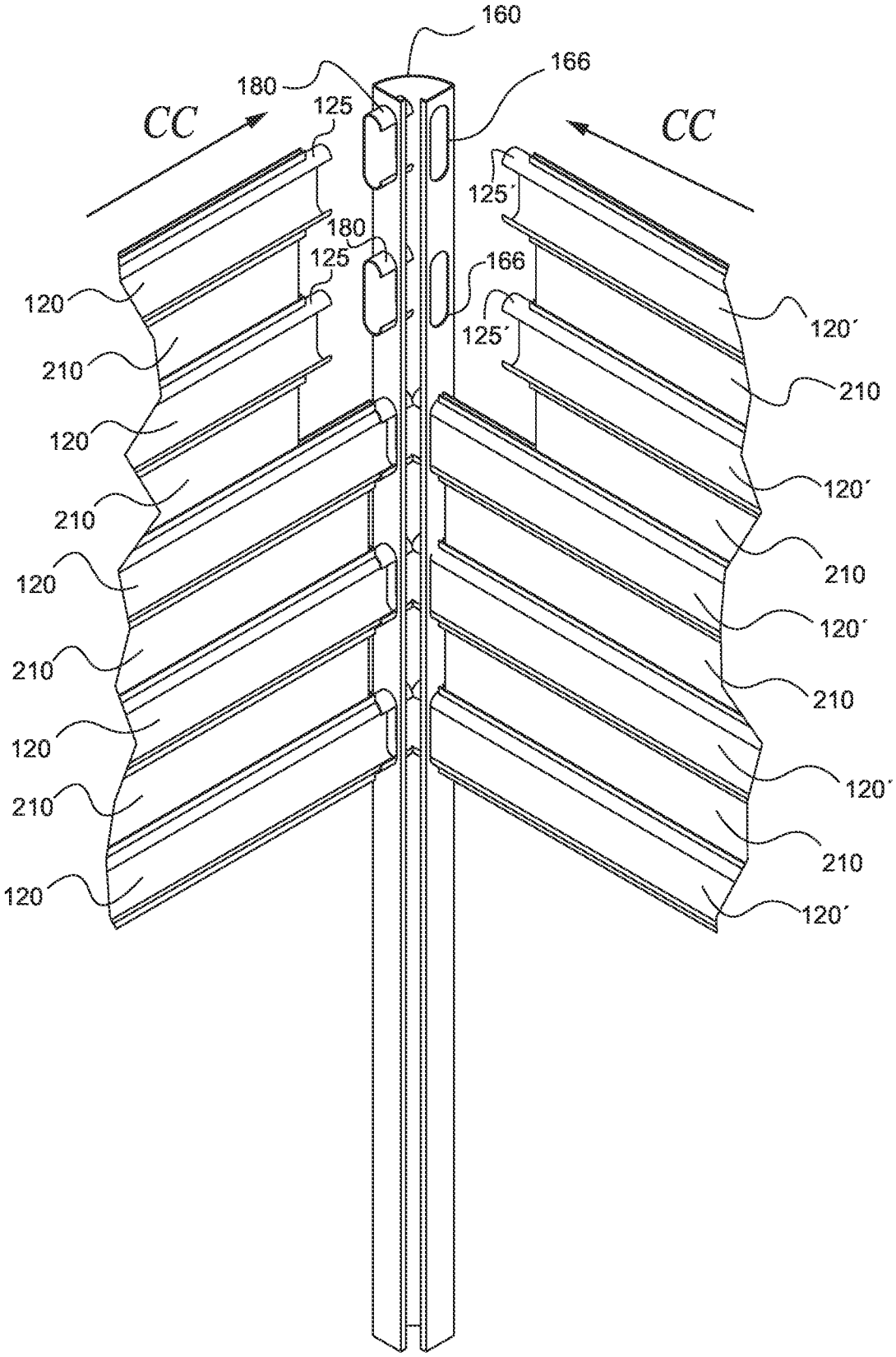
FIGS. 16-18 show views of an assembly of male fence rails of FIG. 2 and female fence rails of FIG. 3 with the corner fence post of FIG. 14, and also with panels and rail adapter sleeves.
Figure 17:
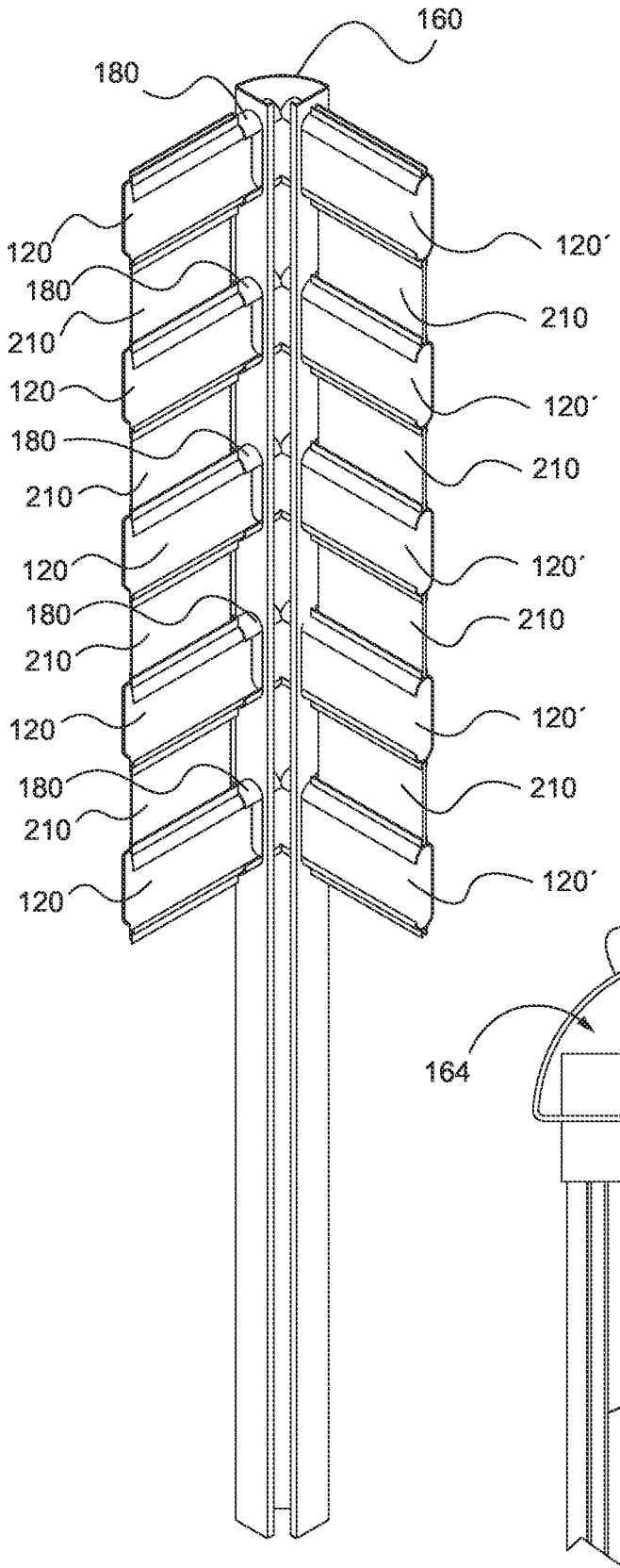
Figure 18:
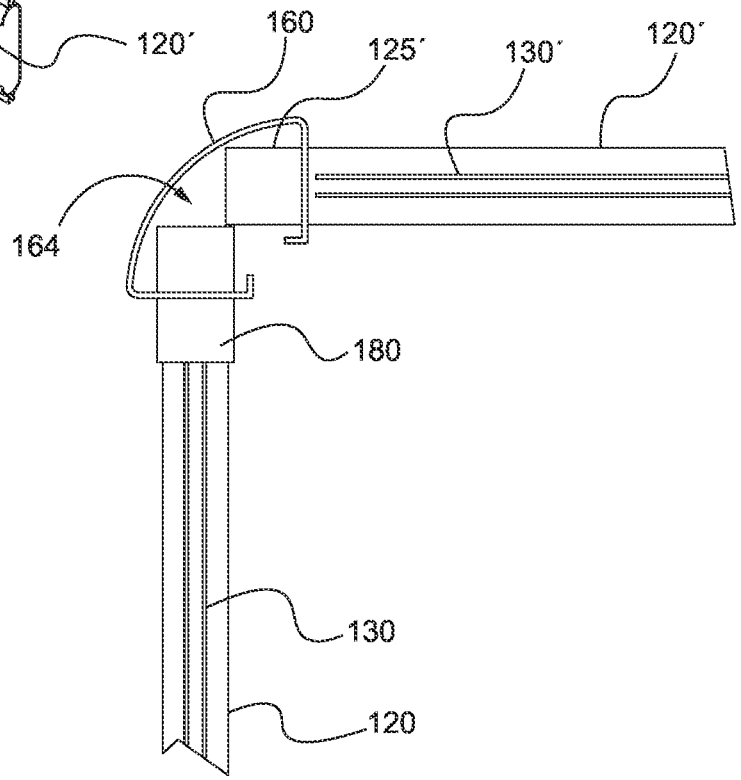

Assembly of the corner fence post 160 and fence rails 120,120' described above to form a portion of the fence system 100 is shown in FIGS. 16 to 18. Before or after the corner fence post 160 is planted or otherwise secured in the ground or other surface onto which the fence system 100 is to be installed, one or more fence rails 120,120' may each be aligned with a corresponding one of the rail openings 166 of the corner fence post 160. Each of the female fence rails 120' may be longitudinally moved along its respective longitudinal axis $L'_R$ as illustrated by arrow CC so as to fittingly insert the longitudinal end 125' thereof into the corresponding rail opening 166, such that the longitudinal end 125' of the female fence rail 120' extends into the channel 164 of the corner fence post 160. Each of the male fence rails 120 may be coupled at a longitudinal end 125 thereof with a rail adapter sleeve 180 such that the rail adapter sleeve 180 overlaps the longitudinal end 125. The male fence rail 120 and rail adapter sleeve 180 so coupled may be moved along the longitudinal axis $L_R$ of the male fence rail 120 so as to fittingly insert the rail adapter sleeve 180 into the corresponding rail opening 166, such that the rail adapter sleeve 180, and optionally also the longitudinal end 125 of the male fence rail 120, extend into the channel 164 of the corner fence post 160. The rail adapter sleeve 180 may be a hollow obround right prism substantially identical or similar in shape to the main body 121' of the female fence rail 120' having a relatively short longitudinal length along the longitudinal axis $L'_R$ thereof. The rail adapter sleeve 180 may thus be mated with the longitudinal end 125 of the male fence rail 120 substantially in the same way as described above as a female fence rail 120' may be mated with a male fence rail 120. In this way, each of the rail openings 166 of the corner fence post 160 may be commonly sized and shaped for fitting insertion of a longitudinal end 125' of a female fence rail 120', or, as described, a rail adapter sleeve 180 having substantially the same cross-sectional profile in the plane defined by the vertical axis $V_R$ and the transverse axis $T_R$. In this way, construction of the corner fence post 160 and construction of the fence system 100 may be simplified. Alternatively, one or some of the rail openings 166 may instead be sized and shaped for fitting insertion of a longitudinal end 125 of a male fence rail 120, in which case use of a rail adapter sleeve 180 as described is not required.

As indicated, each rail opening 166 of the corner fence post 160 may have a substantially stadium, or obround, shape, and may have a size and shape which is substantially the same, nearly the same, or similar to the outer surface 127' of the main body 121' of the female fence rail 120' at a longitudinal end 125' thereof. Thus, vertical and horizontal dimensions of the rail openings 166 extending respectively along the vertical axis $V_C$, on the one hand, and the first insertion axis $I1_C$ or the second insertion axis $I2_C$, as the case may be, on the other hand, may be substantially similar to, or slightly greater than, the outside height $h'_{BO}$ and outside width $w'_{BO}$, of the female fence rail 120' main body 121'. In particular, a spacing or tolerance between the outer surface 127' of the female fence rail 120' and an inner boundary 167 of the rail opening 166 may be preconfigured such that the longitudinal end 125' of the female fence rail 120', or the rail adapter sleeve 180, is slidingly and fittingly insertable into the rail opening 166 with a preconfigured degree of frictional sliding resistance. The preconfigured degree of frictional sliding resistance may be such as to achieve a particular functional effect, which may include to permit ready and easy manual insertion of the female fence rail 120' or rail adapter sleeve 180 as described, while resisting relative motion of, including sliding removal of, the female fence rail 120' or rail adapter sleeve 180 from the rail opening 166 absent a threshold separation force. As indicated above, the components of the fence system 100 may be so sized, shaped, and configured to permit at least some relative movement to accommodate for expansion and contraction experienced as a result of temperature fluctuations. The described spacing or tolerance of the female fence rail 120' or rail adapter sleeve 180 and the rail opening 166 may be preconfigured to permit such temperature-related relative movement, while also providing sufficient frictional sliding resistance to prevent or resist relative longitudinal movement and removal of the female fence rail 120' or rail adapter sleeve 180 it is inserted in the rail opening 166 as described.

Figure 19:
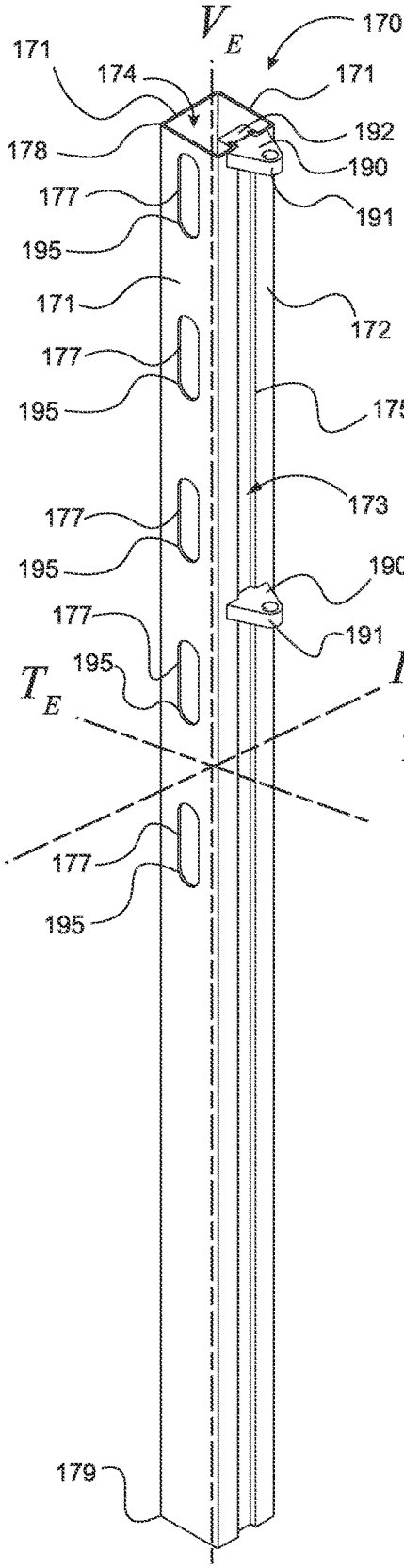
FIG. 19 shows a perspective view of an end fence post.
Figure 20:
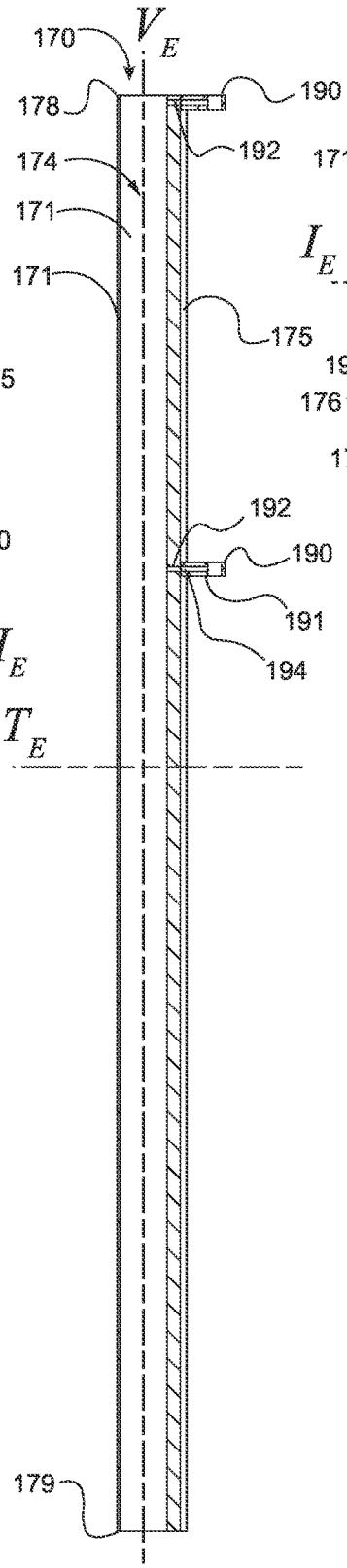
FIG. 20 shows a vertical cross-sectional view of the end fence post of FIG. 19.
Figure 21:
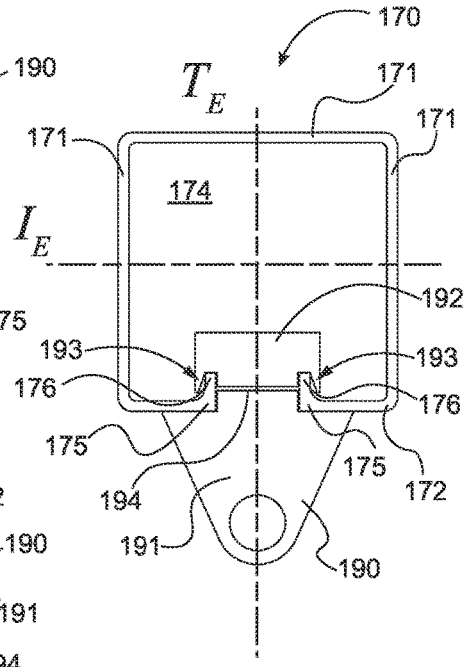
FIG. 21 shows a transverse cross-sectional view of the end fence post of FIG. 19.

FIGS. 19 to 21 show an end fence post 170 of the fence system 100. The end fence post 170 may be characterized by a vertical axis $V_E$, an insertion axis $I_E$, and a transverse axis $T_E$ which are mutually orthogonal. As shown particularly in FIG. 21, a cross-sectional profile of the end fence post 170 in a plane of the insertion axis $I_E$ and the transverse axis $T_E$ is in the shape of a rectangle, which may be a square, having four walls 171,172, wherein one wall 172 forms an opening or slot 173 extending along the vertical axis $V_E$. The four walls 171,172 may together define a channel 174 extending along the vertical axis $V_E$. The wall 172 forming the slot 173 may form at each of two opposing vertical edges 175 of the slot 173 corresponding flanges 176 which project partly inwardly into the channel 174 orthogonally to the wall 172 and which extend along the vertical axis $V_E$. At least one of the walls 171 may be formed with at least one rail opening 177. When the wall 171 has multiple rail openings 177, they may be spaced along the vertical axis $V_E$, which spacing may be equal or unequal with respect to one or more pairs of adjacent rail openings 177. Each rail opening 177 may have a substantially stadium, or obround, shape, and may have a size and shape which is substantially the same, nearly the same, or similar to an outer surface 127' of the main body 121' of the female fence rail 120' at a longitudinal end 125' thereof. The end fence post 170 may further have or cooperate with one or more hinge knuckle modules 190 having a hinge knuckle 191 which when mounted projects horizontally from the wall 172 along the transverse axis $T_E$, and a retention body 192 affixed to or integral with the hinge knuckle 191, with a bridging portion 194 extending between the hinge knuckle 191 and the retention body 192. The hinge knuckle 191 and the retention body 192 may together define therebetween a pair of mounting slots 193 sized, shaped, and configured for sliding and fittingly receiving the wall 172 and flanges 176 when the hinge knuckle module 190 is horizontally positioned at an upper end 178 or lower end 179 of the end fence post 170 with the retention body 192 in vertical alignment with the channel 174 and the bridging portion 194 in vertical alignment with the slot 173, and when the hinge knuckle module 190 and the end fence post 170 thus positioned are moved vertically together. In this manner, one or more hinge knuckle modules 190 may be slidingly mounted to the end fence post 170. The hinge knuckles 191 thereof may be sized, shaped, and configured for coupling to corresponding structures, such as cooperating hinge knuckles, of a gate (not shown) or other structure. Each of the hinge knuckle modules 190 may be adjustable vertically to configure the end fence post 170 with hinge knuckle modules 190 for coupling and use with different gates or other structures having cooperating hinge knuckles or other coupling structures with different vertical spacings.

Figure 22:
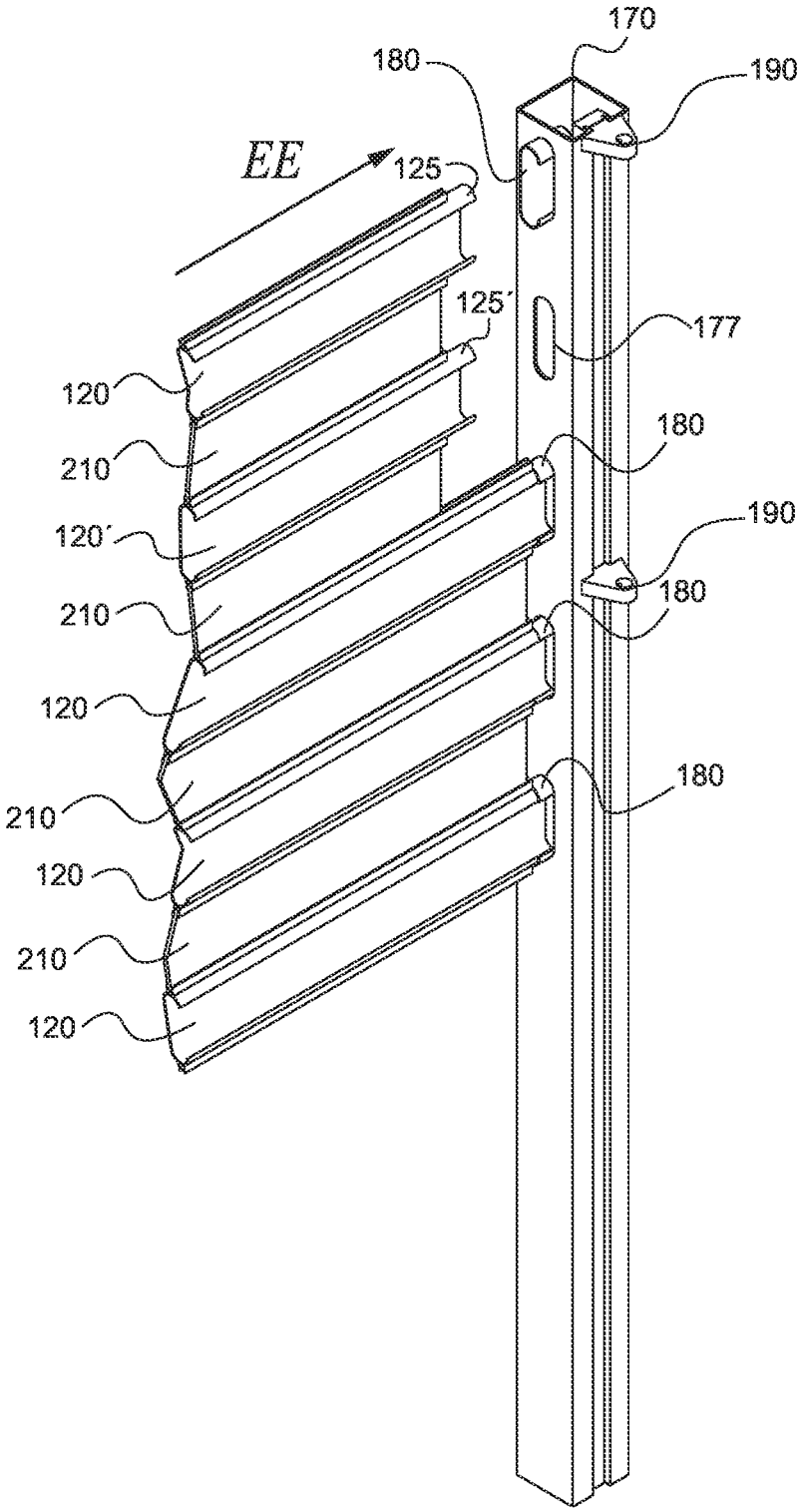
FIGS. 22-24 show views of an assembly of male fence rails of FIG. 2 and female fence rails of FIG. 3 with the end fence post of FIG. 19, and also with panels and rail adapter sleeves.
Figure 23:
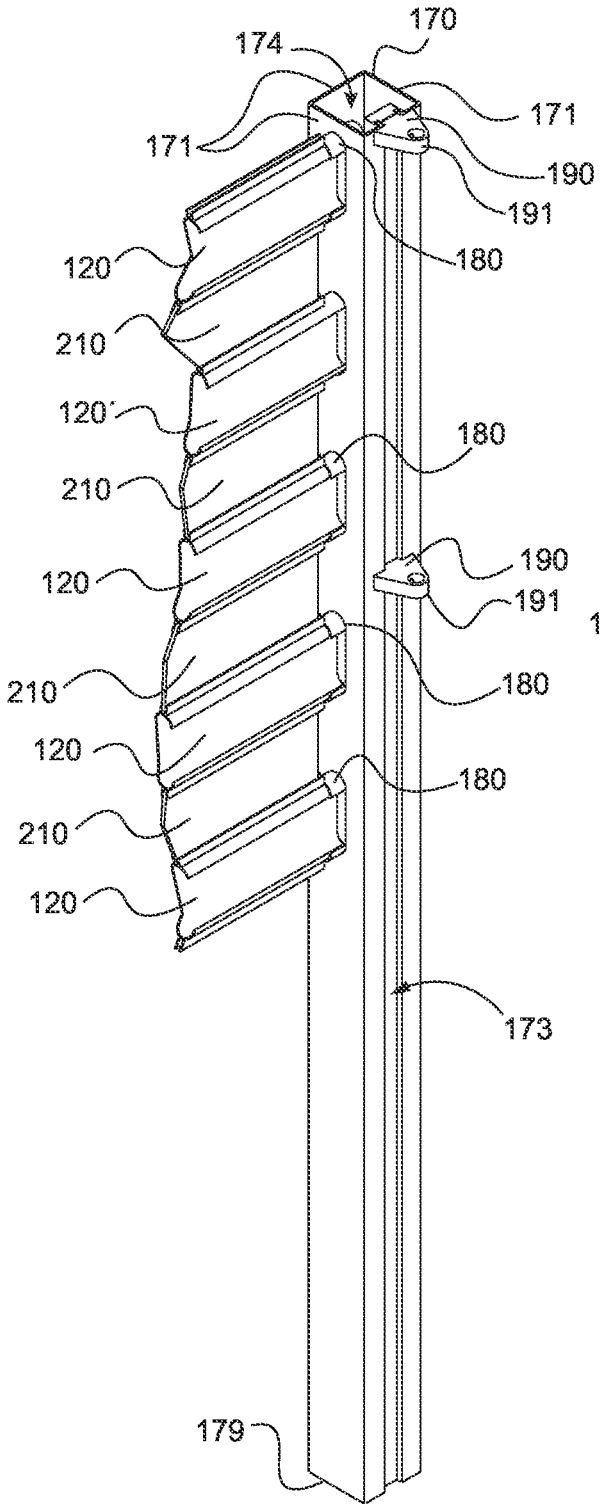
Figure 24:
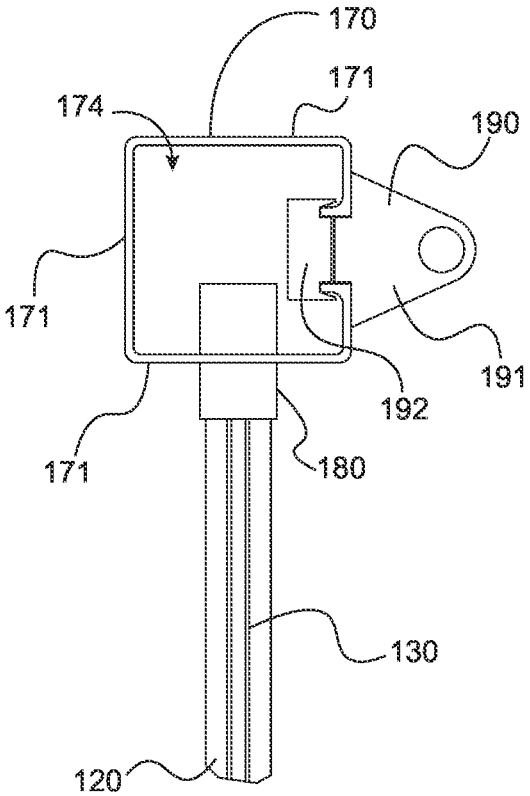

Assembly of the end fence post 170 and fence rails 120,120' described above to form a portion of the fence system 100 is shown in FIGS. 22 to 24. Before or after the end fence post 170 is planted or otherwise secured in the ground or other surface onto which the fence system 100 is to be installed, one or more fence rails 120,120' may each be aligned with a corresponding one of the rail openings 177 of the end fence post 170. Each of the female fence rails 120' may be longitudinally moved along its respective longitudinal axis $L'_R$ as shown by arrow EE so as to fittingly insert the longitudinal end 125' thereof into the corresponding rail opening 177, such that the longitudinal end 125' of the female fence rail 120' extends into the channel 174 of the end fence post 170. Each of the male fence rails 120 may be coupled at a longitudinal end 125 thereof with a rail adapter sleeve 180 such that the rail adapter sleeve 180 overlaps the longitudinal end 125 of the male fence rail 120. The male fence rail 120 and rail adapter sleeve 180 so coupled may be moved along the longitudinal axis $L_R$ of the male fence rail 120, along arrow EE, so as to fittingly insert the rail adapter sleeve 180 into the corresponding rail opening 177, such that the rail adapter sleeve 180, and optionally also the longitudinal end 125 of the male fence rail 120, extend into the channel 174 of the end fence post 170. Alternatively, the rail adapter sleeve 180 may be inserted into the rail opening 177 first, and then the longitudinal end 125 of the mail fence rail 120 may be inserted into and coupled with the rail adapter sleeve 180. In this way, each of the rail openings 177 of the end fence post 170 may be commonly sized and shaped for fitting insertion of a longitudinal end 125' of a female fence rail 120', or, as described, a rail adapter sleeve 180 having substantially the same cross-sectional profile in the plane defined by the vertical axis $V_R$ and the transverse axis $T_R$. In this way, construction of the end fence post 170 and construction of the fence system 100 may be simplified. Alternatively, one or some of the rail openings 177 may instead be sized and shaped for fitting insertion of a longitudinal end 125 of a male fence rail 120, in which case use of a rail adapter sleeve 180 as described is not required.

As indicated, each rail opening 177 of the end fence post 170 may have a substantially stadium, or obround, shape, and may have a size and shape which is substantially the same, nearly the same, or similar to the outer surface 127' of the main body 121' of the female fence rail 120' at a longitudinal end 125' thereof. Thus, vertical and horizontal dimensions of the rail openings 177 extending respectively along the vertical axis $V_E$ and the insertion axis $T_E$ may be substantially similar to, or slightly greater than, the outside height $h'_{BO}$ and outside width $w'_{BO}$, of the female fence rail 120' main body 121'. In particular, a spacing or tolerance between the outer surface 127' of the female fence rail 120' and an inner boundary 195 of the rail opening 177 may be preconfigured such that the longitudinal end 125' of the female fence rail 120', or the rail adapter sleeve 180, is slidingly and fittingly insertable into the rail opening 177 with a preconfigured degree of frictional sliding resistance. The preconfigured degree of frictional sliding resistance may be such as to achieve a particular functional effect, which may include to permit ready and easy manual insertion of the female fence rail 120' or rail adapter sleeve 180 as described, while resisting relative motion of, including sliding removal of, the female fence rail 120' or rail adapter sleeve 180 from the rail opening 177 absent a threshold separation force. As indicated above, the components of the fence system 100 may be so sized, shaped, and configured to permit at least some relative movement to accommodate for expansion and contraction experienced as a result of temperature fluctuations. The described spacing or tolerance of the female fence rail 120' or rail adapter sleeve 180 and the rail opening 177 may be preconfigured to permit such temperature-related relative movement, while also providing sufficient frictional sliding resistance to prevent or resist relative longitudinal movement and removal of the female fence rail 120' or rail adapter sleeve 180 it is inserted in the rail opening 177 as described.

Thus, in the manner described above, a fence system 100 may be assembled, installed, mounted, and provided including any desired combination of fence posts 110, including any desired combination of the middle fence posts 150, corner fence posts 160, and end fence posts 170, and any desired combination of the male fence rails 120 and female fence rails 120' and, optionally, rail adapter sleeves 180. The fence system 100 may be readily, easily, and rapidly assembled without the requirement of tools or fasteners. Given the relative size, shape, and configuration of its components, the fence system 100 may nevertheless maintain its assembled state indefinitely, while at the same time accommodating the expansion and contraction of its components resulting from environmental temperature fluctuations. Different embodiments of the fence system 100 include or omit a fence rail 120,120' at each pair of opposing rail openings 153,166,177 of the pair of fence posts 110 which bracket the fence rail 120,120'. In other words, the design of the fence system 100 readily permits different selected spacings of the fence rails 120,120'. The fence system 100 may likewise be readily, easily, and rapidly disassembled without the requirement tools and with no or minimal damage to the fence system 100 components as a result of such disassembly, in contrast to previous fence systems whose assembly required the use of fasteners.

As discussed above, the rail openings 153,166,177, on the one hand, and the female fence rails 120' and rail adapter sleeves 180, on the other hand, may be so respective sized, shaped, and configured so as to enable ready sliding insertion of the female fence rail 120' longitudinal ends 125' and the rail adapter sleeves 180 into the rail openings 153,166, 177, while providing a preconfigured degree of frictional sliding resistance may be such as to achieve a particular functional effect. In addition, the rail openings 153,166,177, on the one hand, and the female fence rails 120' and rail adapter sleeves 180, on the other hand, may be so respective sized, shaped, and configured to enable a preconfigured degree of relative angular deflection, or a preconfigured amount of angular deflection from perfect longitudinal alignment. In particular, such sizing, shaping, and configuration may enable assembly and installation of one or more sections of the fence system 100 on or over uneven ground or other supporting surface, such that the rail openings 153,166,177 of the fence posts 110 bracketing and supporting one or more of the male fence rails 120 and female fence rails 120' have different respective altitudes, with the result that the one or more of the male fence rails 120 and female fence rails 120' are oriented at a non-perpendicular angle from the bracketing fence posts 110. In such a configuration, when the bracketing fence posts 110 are vertical, the one or more of the male fence rails 120 and female fence rails 120' when installed as described may be orientated with a degree of angular displacement from the horizontal, i.e. sloped. In this way, the fence system 100 may be installed on or over uneven ground or other surface, with at least some degree of play or tolerance in the fit between the rail openings 153, 166,177, on the one hand, and the female fence rails 120' and rail adapter sleeves 180, on the other hand.

Figure 25:
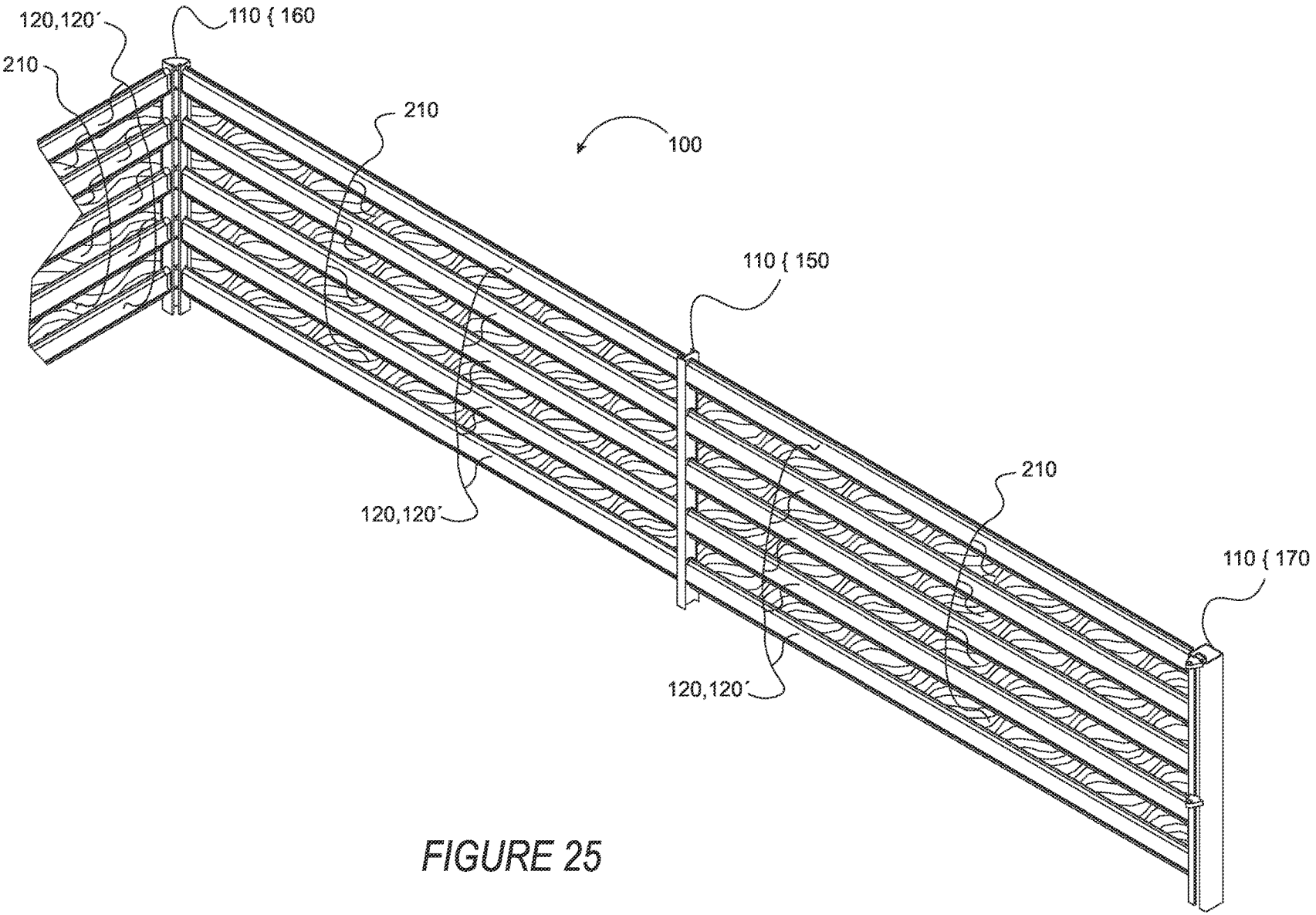
FIG. 25 shows a perspective view of a fence system of FIG. 1 with panels installed.

In some embodiments of the fence system 100, adjacent fence rails 120,120' may define therebetween an opening 200 (see FIG. 1) permitting the passage of light and air, among other things. In other embodiments of the fence system 100, one or more of the openings 200 may be fully or partly closed by one or more panels 210, as shown in FIG. 25. Full or partial closure of the one or more openings 200 by the one or more panels 210 may render the fence system 100 particularly advantageous in applications where it is desired to prevent on inhibit the passage of light, air, or other things through the openings 200. As one non-limiting example, a fence system 100 with panels 210 may be useful to prevent or inhibit entry of persons onto a site, such as a construction site or a swimming pool area, as is required by some municipal or other legal or safety codes. In another non-limiting example, a fence system 100 with panels 210 may be useful to prevent or inhibit exit of animals or persons from a site. Other advantageous uses and applications are possible and contemplated.

While, as shown, a panel 210 is provided and mounted between each vertically adjacent pair of the fence rails 120,120', it will be understood that any desired combination and arrangement of the fence posts 110,150,160,170 the corresponding inclusion or omission of the fence rails 120, 120', and the corresponding inclusion or omission of the panels 210 is possible and contemplated. The panels 210 may be formed of any suitable sheet material and may have any suitable dimensions consistent with the uses and configurations described herein. In particular, the sheet material may include plywood, wood lumber sheets, thermoplastic, fibreglass, or any other suitable sufficiently rigid, sufficiently flexible, sufficiently durable sheet material.

Figure 26:
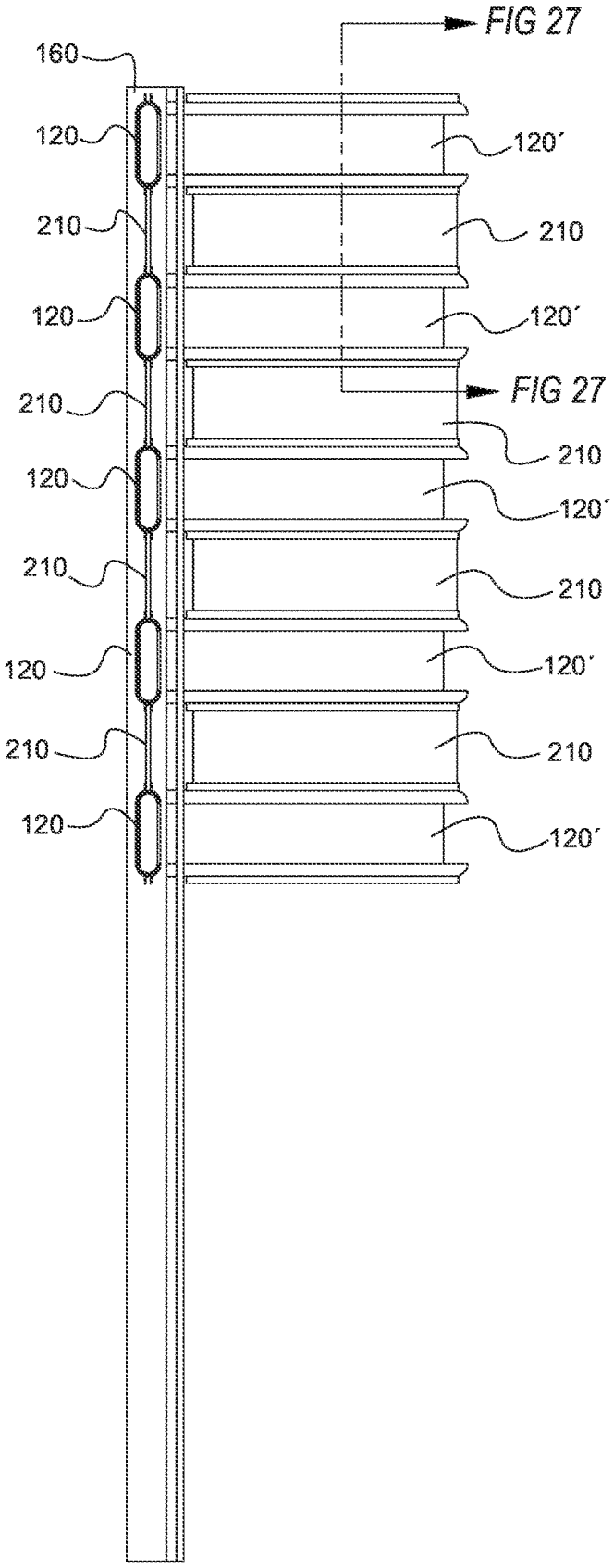
FIGS. 26 & 27 show a partial section of the fence system of FIG. 1 comprising fence rails having upper and lower panel slots of equal height with panels installed.
Figure 27:
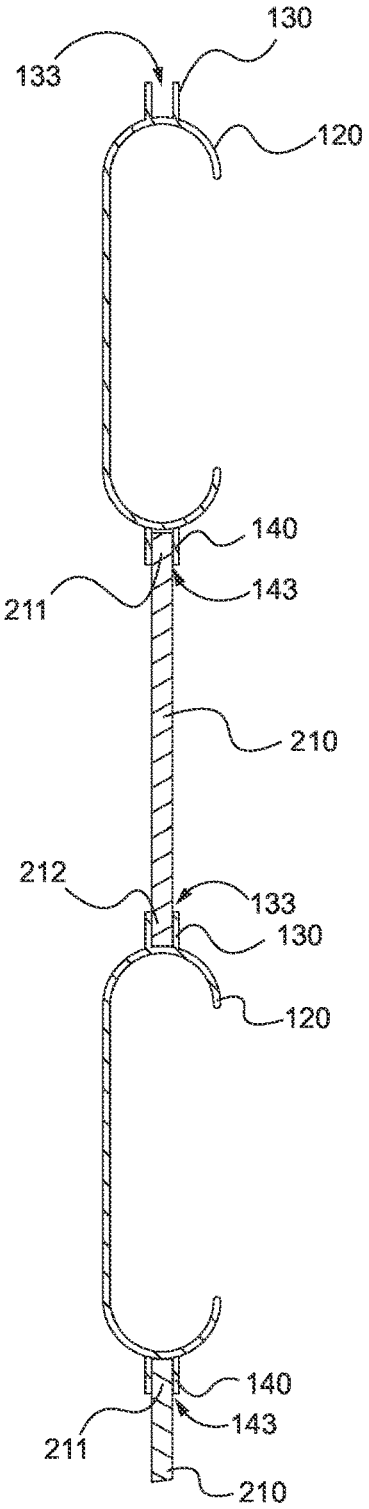

With reference to FIG. 17 previously discussed, and FIGS. 25 to 27, one or more panels 210 may be installed, positioned, and provided between corresponding vertically adjacent fence rails 120,120', and in particular by vertical and longitudinal alignment of the panel 210 with a corresponding and opposing lower panel slot 140 of an abutting fence rail 120 vertically above the panel 210 and also with a corresponding and opposing upper panel slot 130 of an abutting fence rail 120 vertically below the panel 210. In particular, an upper edge 211 of the panel 210 may be slidingly inserted into the channel 143 of the lower panel slot 140 of the abutting fence rail 120 above the panel 210, and a lower edge 212 of the panel 210 may be slidingly inserted into the channel 133 of the upper panel slot 130 of the abutting fence rail 120 below the panel 210. The two fence rails 120 and the panel 210 may be so assembled in any convenient manner. For example, a first one of the upper fence rail 120 and the lower fence rail 120 may be placed into position first, then the panel 210 may be coupled with it as described, then the other, second one of the upper fence rail 120 and the lower fence rail 120 may placed into position while assembling it with the panel 210 as described. Alternatively, the upper fence rail 120 and the lower fence rail 120 may be placed into position first, and then the panel 210 may be installed as described, which may be by longitudinally sliding the upper edge 211 and the lower edge 212 of the panel 210 respectively into the lower panel slot 140 of the upper fence post 120 and the upper panel slot 130 of the lower fence post 120 from a longitudinal end of the fence posts 120. It will also be understood that although FIG. 27 shows only male fence rails 120, it will be understood that any combination of male fence rails 120 and female fence rails 120' may be used as the upper fence rail and the lower fence rails which bracket the block sheets 210, as described. In addition, while the example shown and described in FIGS. 26 & 27 involves a corner fence post 160, it will be understood that any combination of fence posts 110,150, 160,170 may be assembled and used with the fence rails 120,120' and panels 210 as described, as shown for example in FIGS. 8 to 10, 12, 13, 16, 17, 22 and 23.

As described above, and as shown especially in FIG. 27, in some embodiments the panel 210 may be so sized, shaped, and configured such that when installed between two, bracketing fence rails 120,120', the upper edge 211 of the panel 210 is fittingly received and retained in the lower panel slot 140,140' of the upper fence rail 120,120' positioned above the panel 210, and the lower edge 212 of the panel 210 is fittingly received and retained in the upper panel slot 130,130' of the lower fence rail 120,120' positioned below the panel 210. In such embodiments, the fence rails 120,120' and the panel 210 may be assembled step-wise in the alternative manners described above which accommodate the foregoing relationship of the parts. Since a section of the fence system 100 will typically include a number of fence rails 120,120' bracketed and supported by a pair of the fence posts 110, as described above, in some embodiments installation are de-installation of panels 210 may constitute a step coordinated with the assembly or disassembly of the fence rails 120,120' and bracketing fence posts 110.

Figure 28:
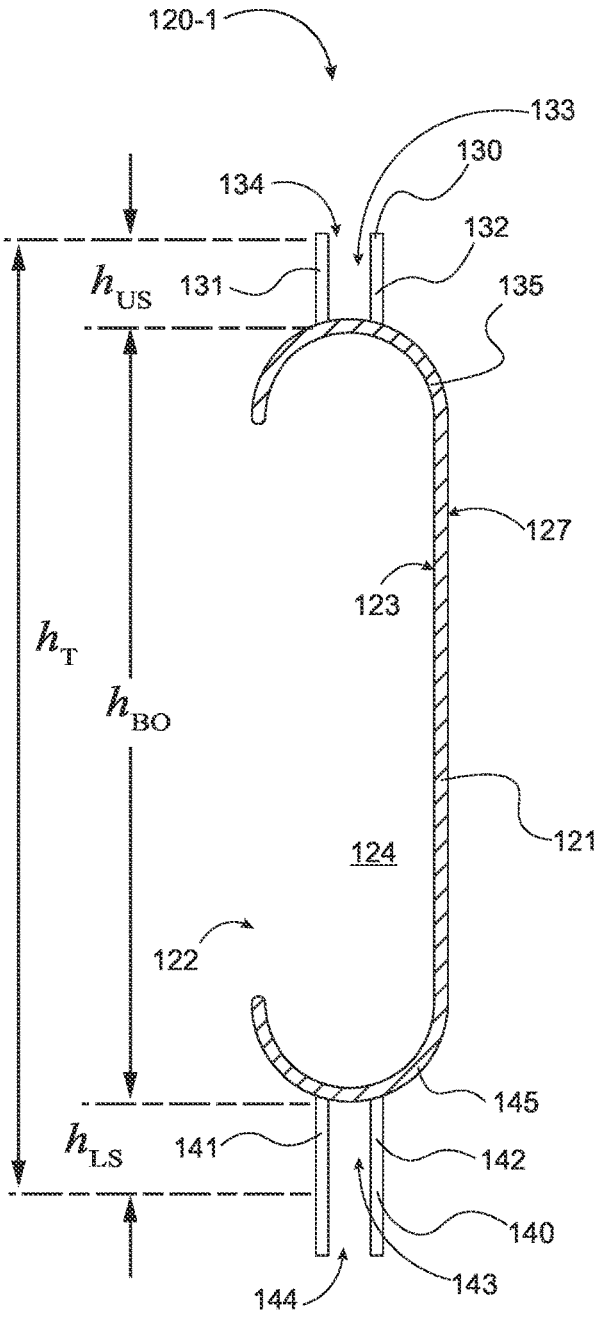
FIGS. 28 & 29 show cross-sectional views of variants of the male fence rail of FIG. 2 and the female fence rail of FIG. 3 having upper and lower panel slots of different height.
Figure 29:
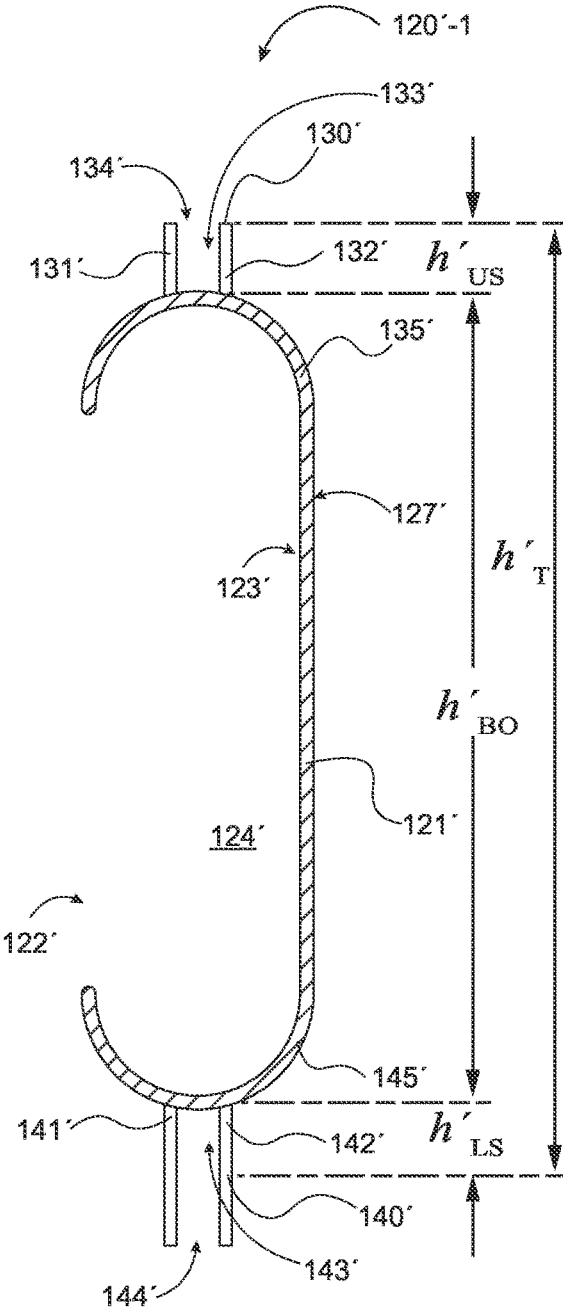

In other embodiments, the panels 210 may be reversibly installed and uninstalled after complete assembly of a section of the fence system 100, without requiring coordination of the panel 210 installation or uninstallation of the fence system 100 section, or otherwise disturbing the state of assembly of the section of the fence system 100. For this purpose, as shown in FIGS. 28 & 29, male fence rail 120-1 is a particular embodiment of male fence rail 120, and female fence rail 120'-1 is a particular embodiment of female fence rail 120'. As described above, the male fence rail 120-1 may have an upper panel slot 130 and a lower panel slot 140, and the female fence rail 120' may have an upper panel slot 130' and a lower panel slot 140'. In the particular embodiment of the male fence rail 120-1, the height $h_{US}$ of the upper panel slot 130 and the height $h_{LS}$ of the lower panel slot 140 are different. Similarly, in the particular embodiment of the female fence rail 120'-1, the height $h'_{US}$ of the upper panel slot 130' and the height $h'_{LS}$ of the lower panel slot 140' are different. Specifically, and as shown in FIGS. 28 & 29, the respective heights $h_{US}$, $h'_{US}$ of the upper panel slots 130,130' are less than the respective heights $h_{LS}$,$h'_{LS}$ of the lower panel slots 140,140'. When the fence system 100 has a section having a pair of fence rails 120 including an upper fence rail vertically adjacent a lower fence rail, where the upper fence rail is one of the male fence rail 120-1 and female fence rail 120'-1, and the lower fence rail is also one of the male fence rail 120-1 and female fence rail 120'-1, then one or more panels 210 may be installed between the upper fence rail and the lower fence rail without requiring coordination with assembly of the section or otherwise disturbing the assembled state of the section.

Figure 30:
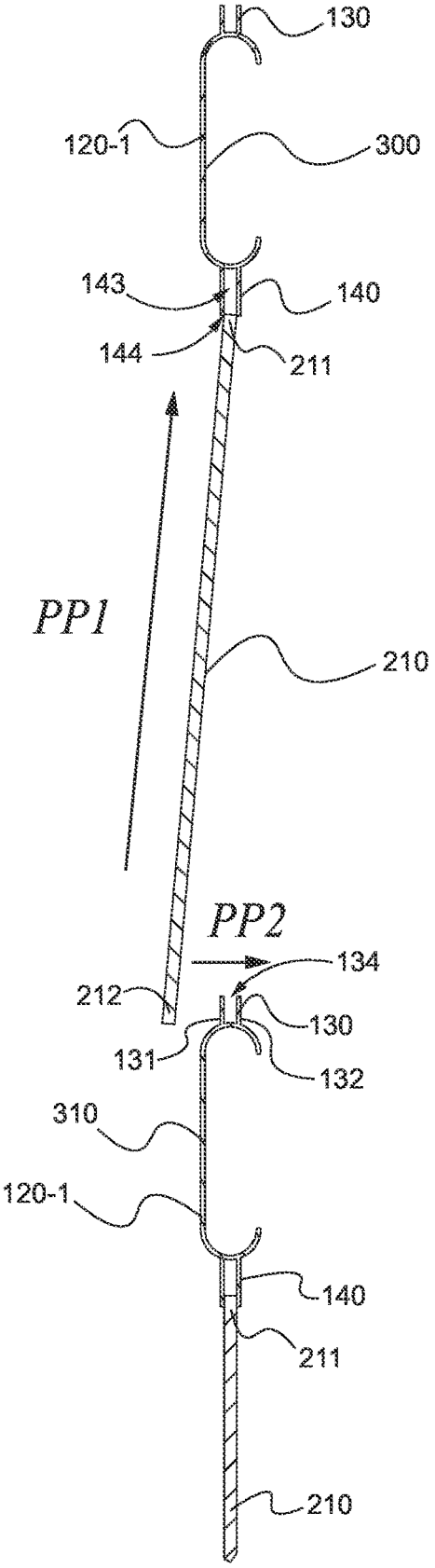
FIGS. 30-34 show views of a panel installation procedure using the male fence rails and female fence rails having upper and lower panel slots of different height of FIGS. 28 & 29.
Figure 31:
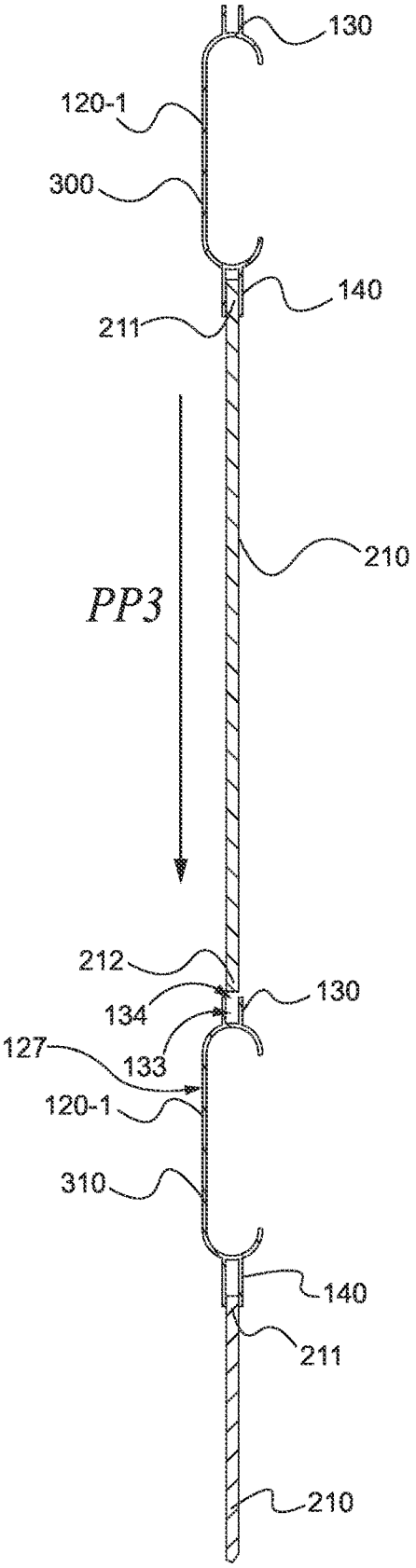
Figure 32:
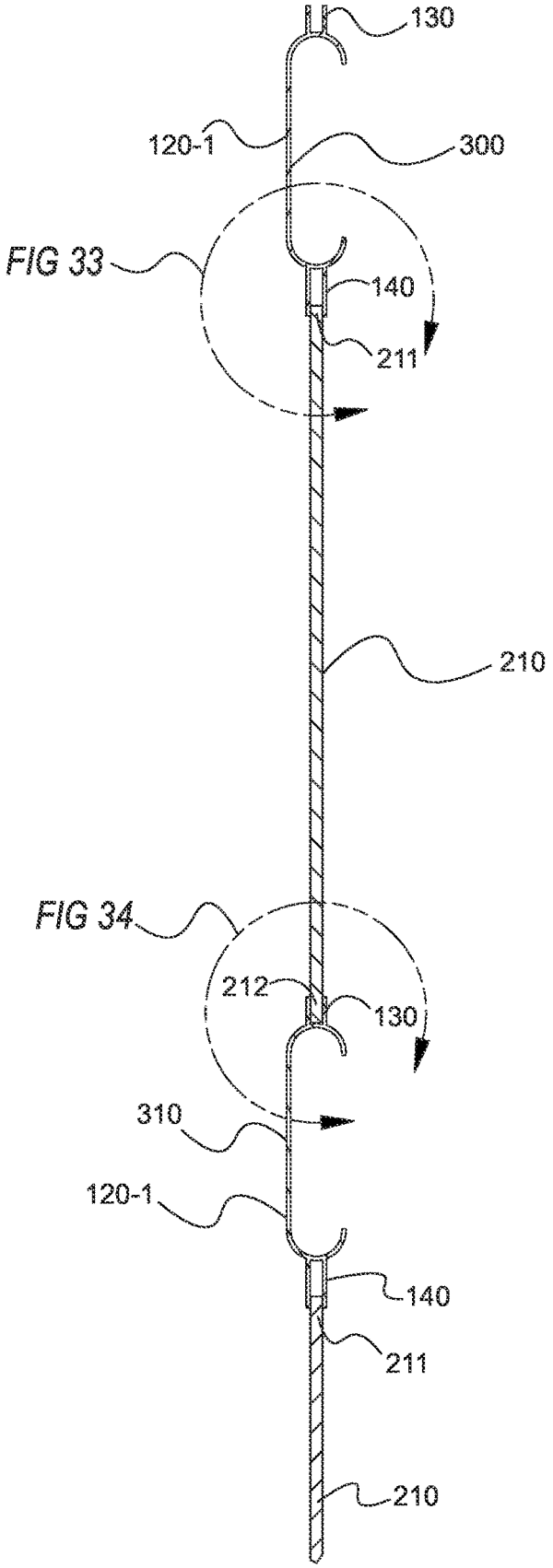
Figure 33:
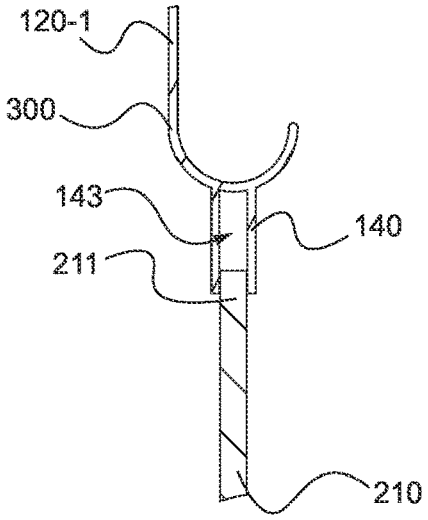
Figure 34:
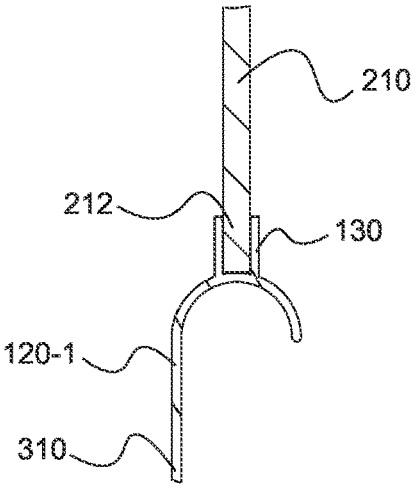

Reference in this regard is made to FIGS. 30 to 34 which illustrate installation of a panel 210 in accordance with the foregoing. The example shown involves two of the male fence rails 120-1, but any combination of male fence rails 120-1 and female fence rails 120'-1 is possible. As shown in FIG. 30, the panel 210 may be moved so as to position the upper edge 211 adjacent and longitudinally parallel with the opening 144 of the lower panel slot 140 of an upper fence rail 300, and with the lower edge 212 of the panel 210 adjacent and longitudinally parallel with one of the flanges 131,132 of the upper panel slot 130 of the lower fence rail 310. The panel 210 may then be raised in the direction of arrow PP1 so as to insert the upper edge 211 of the panel 210 into the channel 143 of the lower panel slot 140 of the upper fence rail 300 while tilting the panel 210 toward and to a vertical orientation, as illustrated by arrow PP2, wherein the lower edge 212 of the panel is raised above the opening 134 of the upper panel slot 130 of the lower fence panel 310, to the vertical orientation wherein the panel 210 is vertically aligned with the lower panel slot 140 of the upper fence panel 300 and the upper panel slot 130 of the lower fence panel 310, with the upper edge 211 of the panel within the channel 143 of that lower panel slot 140. Such position produced by the described motion is shown in FIG. 31. The panel 210 may then be lowered in the direction of arrow PP3 such that its lower edge 212 is received into the channel 133 of the upper panel slot 130 of the lower fence panel 310, and the lower edge 212 of the panel 210 comes into contact, rests against, and is supported by the outer surface 127 of the lower fence rail 310 at the bottom of the upper panel slot 130 channel 133. Such position produced by the described motion is shown in FIGS. 32 to 34. Since the height $h_{US}$ of the upper panel slot 130 of the lower fence rail 310 is less than the height $h_{LS}$ of the lower panel slot 140 of the upper fence rail 300, at least a portion of the upper edge 211 of the panel 210 remains within the channel 143 of the lower panel slot 140 of the upper fence rail 300. In this way, the described lower panel slot 140 and upper panel slot 130 are operative to retain the panel 210 in the installed state as described. A width of the channels 133,143 relative to a thickness of the panel 210 may be such that in the installed state there may remain a gap which permits either or both expansion and contraction of thickness at the panel edges 211,212 and/or a longitudinal length of the panel 210 parallel to the fence rails 300,310 due to temperature variations or otherwise. The panel 210 may be readily and easily uninstalled by performance of the reverse of the described installation procedure.

The male fence rails 120, female fence rails 120', rail adapter sleeves 180, and fence posts 110, may formed from any suitable sufficiently rigid, sufficiently durable material. For example, one or more of the forgoing may be formed from metal, which may be steel or aluminum, plastics, which may be thermoplastics, ceramics, or fibreglass. The noted components may be formed and manufactured by any suitable method, including molding, additive manufacturing, such as 3D-printing, and extrusion. In particular, by providing a uniform cross-section orthogonal to the longitudinal axis for an entire length of a component, one or more of the noted components may be conveniently and economically produced by extrusion.

Embodiments of the fence system 100 and components as described and shown herein may have or be characterized by the dimensions specified in Table 1 below, and any combination thereof consistent with the description of the relative configuration, properties, and functionality of the fence system 100 and components. Other dimensions are possible and contemplated.

TABLE 1

| Dimension | From About | To About | Or About |
|---|---|---|---|
| $h_{US}$ | 1 cm | 2 cm | 1.3 cm |
| $h_{LS}$ | 1 cm | 3 cm | 2.5 cm |
| $h_{BO}$ | 9.5 cm | 24.8 cm | 14.5 cm |
| $w_{BO}$ | 1.1 cm | 8.8 cm | 3.7 cm |
| $h_{BI}$ | 9.0 cm | 24.3 cm | 14 cm |
| $w_{BI}$ | 0.6 cm | 8.3 cm | 3.2 cm |
| $h_T$ | 13.2 cm | 28.5 cm | 18.3 cm |
| $h'_{US}$ | 1 cm | 2 cm | 1.3 cm |
| $h'_{LS}$ | 1 cm | 3 cm | 2.5 cm |
| $h'_{BO}$ | 10.1 cm | 25.4 cm | 15.2 cm |
| $w'_{BO}$ | 1.7 cm | 9.4 cm | 4.3 cm |
| $h'_{BI}$ | 9.6 cm | 24.9 cm | 14.7 cm |
| $w'_{BI}$ | 1.2 cm | 8.9 cm | 3.8 cm |
| $h'_T$ | 13.8 cm | 29.2 cm | 19 cm |

The fence system 100 and components as described and shown herein provide numerous advantages over previous fence systems. By the methods described herein, and by virtue of the particular relative configuration of the fence rails 120,120', rail adapter sleeves 180, and fence posts 110, the fence system 100 may be readily and quickly assembled and installed without the requirement of special tools or fasteners. Thus, in any of the embodiments described herein the fence system 100 may be free or substantially free from fasteners or other structures which fasten or adjoin any of the described components to any of the other components. As such, the fence system 100 may be readily and quickly disassembled and uninstalled without or with minimal damage to its components. Moreover, in view of the absence of such fasteners adjoining the different components, the different components may, in an installed configuration, be movable relative to each other within preconfigured tolerances, as described above, and thus may permit differential expansion and contraction, and resulting relative movement, of the different components caused by thermal expansion and contraction due to temperature changes in the surrounding environment, while reducing or eliminating stress and strain that would otherwise develop in previous fence systems whose components are fastened together and rendered immovable relative to each other.

The fence system 100 may be provided as a kit of parts, comprising at least one fence rail 120,120' and a plurality of fence posts 110, including any of fence posts 150,160,170, and optionally one or more further fence rails 120,120' and rail adapter sleeves 180, optionally with a manual or other set of instructions, for convenient transport to an installation site for ready erection and installation of a fence system 100 as described.

By virtue of the absence in one, some, or all of the fence system 100 components of a fully-enclosed interior, one, some, or all of the fence system 100 components may be configured for automatic, convenient, and rapid drainage of water or other fluids, including from any interior of the component. For example, the side openings 122,122' of the fence rails 120,120' may provide automatic, convenient, and rapid drainage of water or other fluids from the interior hollows 124,124' thereof. Similarly, the slot 163 of the corner fence posts 160 may provide automatic, convenient, and rapid drainage of water or other fluids from the channel 164 thereof. Similarly, the slot 173 of the end fence posts 170 may provide automatic, convenient, and rapid drainage of water or other fluids from the channel 174 thereof. The middle fence posts 150 may be configured without any interior hollow or channel, as described above, and by virtue of this fact may permit and facilitate automatic, convenient, and rapid drainage of water or other fluids contacting them. Such automatic, convenient, and rapid drainage may prevent or reduce accumulation of water or other fluids in the interior hollows 124,124' or channels 164,174. This may be of particular advantage in cold climates, where freezing and expansion of such accumulated water or other fluids could cause stress, strain, and damage to the corresponding components.

Moreover, the side openings 122,122' and slots 163,173 provide ready and convenient access to the interior hollows 124,124' and channels 164,174, respectively, for the insertion or removal of any structures or materials more generally.

In addition, by providing the fence rails 120,120' with the described generally obround cross-sectional shape having the side openings 122,122', and in particular which is not a complete unbroken obround, the fence rails 120,120' may possess a preconfigured degree of flexibility in the main bodies 121,121' thereof, so as to permit a preconfigured degree of flexure to extend side openings 122,122' and expand the interior hollows 124,124'. Such flexibility may facilitate or improve the ability to slidingly mate the male fence rails 120, on the one hand, with the female fence rails 120' and rail adapter sleeves 180, on the other hand. Such flexibility may be particularly advantageous when these components are at different temperatures, and therefore at different conditions of expansion or contraction. Similar considerations apply with respect to the insertion of the female fence rails 120' and rail adapter sleeves 180 into the rail openings 153,166,177, that is the female fence rails 120' and rail adapter sleeves 180 may be flexed and bent sufficiently for insertion into the rail openings 153,166,177 when conditions prevent or resist such insertion otherwise.

The following are embodiments according to the disclosure herein.

Embodiment 1. A fence system comprising: a plurality of fence posts; a plurality of fence rails; and at least one rail adapter sleeve; wherein: each fence rail is characterized by a fence rail longitudinal axis and a fence rail cross-sectional profile in a plane orthogonal to the fence rail longitudinal axis; the fence rail cross-sectional profile of each fence rail has a hollow, obround shape with a side opening at one transverse side of the fence rail extending parallel to the fence rail longitudinal axis along an entire length of the fence rail; each fence rail has an upper panel slot at an upper end of the fence rail extending parallel to the fence rail longitudinal axis, wherein each longitudinal end of the upper panel slot is spaced from a corresponding, adjacent longitudinal end of the fence rail, such that a length of the upper panel slot is less than an entire length of the fence rail; each fence rail has a lower panel slot at a lower end of the fence rail extending parallel to the fence rail longitudinal axis, wherein each longitudinal end of the lower panel slot is spaced from a corresponding, adjacent longitudinal end of the fence rail, such that a length of the lower panel slot is less than the entire length of the fence rail; at least some of the fence rails are male fence rails, and at least some of the fence rails are female fence rails; each one of the male fence rails is sized and shaped such that a longitudinal end of the male fence rail is slidably insertable into a longitudinal end opening of one of the female fence rails for longitudinally-aligned mating of the male fence rail and the female fence rail; each rail adapter sleeve is a hollow obround right prism sized and shaped such that, for each one of the male fence rails, a longitudinal end of the male fence rail is sized and shaped such that the longitudinal end of the male fence rail is slidably insertable into an opening of the rail adapter sleeve for mating the male fence rail and the rail adapter sleeve, and an outside width and an outside height of the rail adapter sleeve are substantially the same as an outside width and an outside height of the female fence rails; each fence post has at least one rail opening having a substantially obround shape matching the obround shape of the cross-sectional profile of the female fence rails, whereby a longitudinal end of each female fence rail is slidingly insertable into the rail opening, and each rail adapter sleeve is slidably insertable into the rail opening; at least some of the fence posts are middle fence posts, wherein: each middle fence post is characterized by a middle fence post vertical axis and has a substantially I-beam shape with a web extending parallel to the middle fence post vertical axis and bridging in perpendicular relation two parallel, opposing flanges each extending parallel to the middle fence post vertical axis; the web of each middle fence post has at least one of the rail openings; at least some of the fence posts are corner fence posts, wherein: each corner fence post is characterized by a corner fence post vertical axis and a corner fence post cross-sectional profile in a plane orthogonal to the corner fence post vertical axis; each corner fence post comprises a quarter-circular wall extending parallel to the corner fence post vertical axis an entire length of the corner fence post, and rectangular radial walls adjoining opposing longitudinal edges of the quarter-circular wall and extending parallel to the corner fence post vertical axis the entire length of the corner fence post; opposing longitudinal edges of the rectangular radial walls define a slot extending parallel to the corner fence post vertical axis the entire length of the corner fence post; and the quarter-circular wall and rectangular radial walls define a corner fence post channel extending parallel to the corner fence post vertical axis; each of the rectangular radial walls of each corner fence post has at least one of the rail openings; at least some of the fence posts are end fence posts, wherein: each end fence post is characterized by an end fence post vertical axis and an end fence post cross-sectional profile in a plane orthogonal to the end fence post vertical axis; the end fence post cross-sectional profile has a shape of a rectangle having four sides corresponding to four walls extending parallel to the end fence post vertical axis, the four walls defining a channel extending parallel to the end fence post vertical axis, wherein one of the four walls is a slot wall forming an end fence post slot extending parallel to the end fence post vertical axis and sized and shaped to slidingly receive at least one hinge knuckle module; for each corner fence post, one of the four walls adjacent the slot wall has at least one of the rail openings; each fence rail is mounted to and supported by a corresponding, bracketing pair of the fence posts, wherein longitudinally opposing ends of the fence rail are positioned within corresponding rail openings of the bracketing pair of the fence posts; at least one of the female fence posts is longitudinally mated with a corresponding one of the male fence posts to form an overlapping portion positioned within one of the rail openings of one of the middle fence posts; at least one of the male fence posts has a corresponding one of the rail adapter sleeves mated at a longitudinal end of the male fence post, and the rail adapter sleeve is positioned within one of the rail openings of one of the corner fence posts or end fence posts; at least one pair of the fence rails comprises an upper fence rail and a lower fence rail positioned adjacent, below, and parallel to the upper fence rail, and a panel is positioned between the upper fence rail and the lower fence rail, wherein an upper edge of the panel is positioned within the lower panel slot of the upper fence rail and a lower edge of the panel is positioned within the upper panel slot of the lower fence rail; and the fence system is free from fasteners fastening any of the fence rails, the fence posts, and the rail adapter sleeve to one another.

Embodiment 2. A fence system comprising: a plurality of fence posts; and a fence rail; wherein: the fence rail is characterized by a fence rail longitudinal axis and a fence rail cross-sectional profile in a plane orthogonal to the fence rail longitudinal axis, wherein the fence rail cross-sectional profile has a hollow, obround shape; each fence post has at least one rail opening having a substantially obround shape matching the obround shape of the cross-sectional profile of the fence rail, whereby a longitudinal end of the fence rail is slidingly insertable into the rail opening; and the fence rail is mounted to and supported by a bracketing pair of the fence posts, wherein longitudinally opposing ends of the fence rail are positioned within corresponding rail openings of the bracketing pair of the fence posts.

Embodiment 3. The fence system of Embodiment 2, wherein the fence rail has a side opening at one transverse side of the fence rail extending parallel to the fence rail longitudinal axis.

Embodiment 4. The fence system of Embodiment 3, wherein: the side opening of the fence rail extends an entire length of the fence rail.

Embodiment 5. The fence system of any one of Embodiments 2 to 4, wherein at least one of the fence posts has a substantially I-beam shape with a web extending parallel to a fence post vertical axis of the fence post, the web bridging in perpendicular relation two parallel, opposing flanges each extending parallel to the fence post vertical axis, the web having at least one of the at the at least one rail openings.

Embodiment 6. The fence system of any one of Embodiments 2 to 4, wherein the fence rail is a male fence rail, and fence system further comprises a female fence rail, wherein: a longitudinal end of the male fence rail is longitudinally mated with an end opening of the female fence rail to form an overlapping portion.

Embodiment 7. The fence system of Embodiment 6, wherein: at least one of the fence posts is a middle fence post having a substantially I-beam shape with a web extending parallel to a fence post vertical axis of the fence post, the web bridging in perpendicular relation two parallel, opposing flanges each extending parallel to the fence post vertical axis, the web having at least one of the at the at least one rail openings; and the overlapping portion of the mated male fence rail and female fence rail is positioned in the at least one of the at the at least one rail openings in the web of the at least one of the fence posts.

Embodiment 8. The fence system of any one of Embodiments 2 to 4, wherein the fence rail is an upper fence rail, and the fence system further comprises a lower fence rail, wherein: the lower fence rail has an upper panel slot at an upper end of the lower fence rail extending parallel to the fence rail longitudinal axis; the upper fence rail has a lower panel slot at a lower end of the upper fence rail extending parallel to the fence rail longitudinal axis; the lower fence rail is positioned adjacent, below, and parallel to the upper fence rail; and a panel is positioned between the upper fence rail and the lower fence rail, wherein an upper edge of the panel is positioned within the lower panel slot of the upper fence rail and a lower edge of the panel is positioned within the upper panel slot of the lower fence rail.

Embodiment 9. The fence system of Embodiment 8, wherein: longitudinal ends of the upper panel slot are respectively spaced from corresponding, adjacent longitudinal ends of the lower fence rail, such that a length of the upper panel slot is less than an entire length of the lower fence rail; and longitudinal ends of the lower panel slot are respectively spaced from corresponding, adjacent longitudinal ends of the upper fence rail, such that a length of the lower panel slot is less than the entire length of the upper fence rail.

Embodiment 10. The fence system of Embodiment 8 or 9, wherein a lower panel slot height of the lower panel slot of the upper fence rail is greater than an upper panel slot height of the upper panel slot of the lower fence rail.

Embodiment 11. The fence system of Embodiment 8 or 9, wherein: the lower panel slot defines a lower panel slot channel; the upper panel slot defines an upper panel slot channel; the upper edge of the panel is positioned in the lower panel slot channel; the lower edge of the panel is positioned in the upper panel slot channel; and a lower panel slot channel height of the lower panel slot channel is greater than an upper panel slot channel height of the upper panel slot channel.

Embodiment 12. The fence system of Embodiment 11, wherein: the upper edge of the panel is spaced from an outer surface of the main body of the upper fence rail within the lower panel slot channel.

Embodiment 13. The fence system of Embodiment 12, wherein: the lower edge of the panel contacts and rests upon an outer surface of the main body of the lower fence rail within the upper panel slot channel.

Embodiment 14. The fence system of any one of Embodiments 2 to 4, wherein: at least one of the fence posts comprises walls defines a channel extending parallel to a fence post vertical axis of the fence post, wherein one of the walls defines a slot extending parallel to the fence post vertical axis, and one of the longitudinal ends of the fence rail is positioned within the channel.

Embodiment 15. The fence system of Embodiment 14, wherein the slot extends an entire length of the at least one of the fence posts.

Embodiment 16. The fence system of Embodiment 14 or 15, wherein the at least one of the fence posts is a corner fence post, wherein: the corner fence post has a quarter-circular wall extending parallel to the fence post vertical axis an entire length of the corner fence post; the corner fence post further has two rectangular radial walls each adjoining opposing longitudinal edges of the quarter-circular wall and extending parallel to the fence post vertical axis the entire length of the corner fence post; the quarter-circular wall and the two rectangular radial walls together define the channel; opposing longitudinal edges of the two rectangular radial walls opposite the quarter-circular wall define the slot; and each of the rectangular radial walls has at least one of the rail openings.

Embodiment 17. The fence system of Embodiment 14 or 15, wherein the at least one of the fence posts is an end fence post, wherein: the end fence post has a cross-sectional shape of a rectangle with four walls extending parallel to the fence post vertical axis; the four walls together define the channel; one of the four walls is a slot wall which forms the slot; and a different one of the four walls adjacent the slot wall has at least one of the rail openings.

Embodiment 18. The fence system of Embodiment 17, wherein the slot is sized and shaped to slidingly receive at least one hinge knuckle module.

Embodiment 19. The fence system of any one of Embodiments 16 to 18, further comprising: a rail adapter sleeve having a substantially hollow obround right prism shape; a longitudinal end of the fence rail is longitudinally mated with the rail adapter sleeve; and the substantially obround shape of the at least one rail opening matches the shape of the rail adapter sleeve, and the rail adapter sleeve is positioned in the at least one rail opening.

Embodiment 20. The fence system of any one of Embodiments 2 to 19, wherein the fence rail and the plurality of fence posts are formed of aluminum.

Embodiment 21. The fence system of Embodiment 20, wherein the aluminum is extruded aluminium.

Embodiment 22. The fence system of any one of Embodiments 2 to 21 free from fasteners.

Embodiment 23. A fence rail characterized by a fence rail longitudinal axis and a fence rail cross-sectional profile in a plane orthogonal to the fence rail longitudinal axis, the fence rail cross-sectional profile having a hollow, obround shape with a side opening at one transverse side of the fence rail extending parallel to the fence rail longitudinal axis.

Embodiment 24. The fence rail of Embodiment 23, wherein the side opening extends along an entire length of the fence rail.

Embodiment 25. The fence rail of Embodiment 23 or 24, comprising: an upper panel slot at an upper end of the fence rail extending parallel to the fence rail longitudinal axis; and a lower panel slot at a lower end of the fence rail extending parallel to the fence rail longitudinal axis.

Embodiment 26. The fence rail of Embodiment 25, wherein: each longitudinal end of the upper panel slot is spaced from a corresponding, adjacent longitudinal end of the fence rail, such that a length of the upper panel slot is less than an entire length of the fence rail; and each longitudinal end of the lower panel slot is spaced from a corresponding, adjacent longitudinal end of the fence rail, such that a length of the lower panel slot is less than the entire length of the fence rail.

Embodiment 27. The fence rail of Embodiment 25 or 26, wherein a lower panel slot height of the lower panel slot is greater than an upper panel slot height of the upper panel slot.

Embodiment 28. The fence rail of Embodiment 25 or 26, wherein: the lower panel slot defines a lower panel slot channel; the upper panel slot defines an upper panel slot channel; and a lower panel slot channel height of the lower panel slot channel is greater than an upper panel slot channel height of the upper panel slot channel.

Embodiment 29. The fence rail of any one of Embodiments 23 to 28 formed of aluminum.

Embodiment 30. The fence rail of Embodiment 29, wherein the aluminum is extruded aluminium.

Embodiment 31. A fence post characterized by a fence post vertical axis and having a substantially I-beam shape with a web extending parallel to the fence post vertical axis and bridging in perpendicular relation two parallel, opposing flanges each extending parallel to the fence post vertical axis, wherein the web has at least one rail opening having a substantially obround shape.

Embodiment 32. A fence post characterized by a fence post vertical axis and comprising: a quarter-circular wall extending parallel to the fence post vertical axis an entire length of the corner fence post; two rectangular radial walls each adjoining opposing longitudinal edges of the quarter-circular wall and extending parallel to the fence post vertical axis the entire length of the corner fence post; wherein: the quarter-circular wall and the two rectangular radial walls together define a channel; opposing longitudinal edges of the two rectangular radial walls opposite the quarter-circular wall define a slot; and each of the rectangular radial walls has at least one rail opening having a substantially obround shape.

Embodiment 33. A fence post characterized by a fence post vertical axis and a fence post cross-sectional profile in a plane orthogonal to the fence post vertical axis, wherein: the fence post cross-sectional profile has a shape of a rectangle having four sides corresponding to four walls extending parallel to the fence post vertical axis, the four walls defining a channel; one of the four walls is a slot wall forming a slot; the slot is sized and shaped to slidingly receive at least one hinge knuckle module; one of the four walls adjacent the slot wall has at least one rail opening having a substantially obround shape.

Embodiment 34. The fence post of any one of Embodiments 31 to 33 formed of aluminum.

Embodiment 35. The fence post of Embodiment 34, wherein the aluminum is extruded aluminium.

Embodiment 36. A rail adapter sleeve comprising a hollow obround right prism sized and shaped for sliding mating with a longitudinal end of the fence rail as defined in any one of Embodiments 23 to 30.

Embodiment 37. The rail adapter sleeve of Embodiment 36 formed of aluminum.

Embodiment 38. The rail adapter sleeve of Embodiment 37, wherein the aluminum is extruded aluminium.

Embodiment 39. A kit comprising: at least one fence rail as defined in any one of Embodiments 23 to 30; and a plurality of fence posts as defined in any one of Embodiments 31 to 35.

Embodiment 40. The kit of Embodiment 39 further comprising at least one rail adapter sleeve as defined in any one of Embodiments 36 to 38.

Embodiment 41. The kit of Embodiment 39 or 40 further comprising instructions.

So that the present disclosure may be more readily understood, certain terms are defined. Unless defined otherwise, all technical and scientific terms used herein have the same meaning as commonly understood by one of ordinary skill in the art to which embodiments of the invention pertain. While many methods and materials similar, modified, or equivalent to those described herein can be used in the practice of the embodiments of the present invention without undue experimentation, the preferred materials and methods are described herein.

All terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Numeric ranges recited within the specification are inclusive of the numbers defining the range and include each integer within the defined range. Throughout this disclosure, various aspects of this invention are presented in a range format. It should be understood that the description in range format is merely for convenience and brevity and should not be construed as an inflexible limitation on the scope of the invention. Accordingly, the description of a range should be considered to have specifically disclosed all the possible sub-ranges, fractions, and individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6, etc., as well as individual numbers within that range, for example, 1, 2, 3, 4, 5, and 6, and decimals and fractions, for example, 1.2, 3.8, 1½, and 4%. This applies regardless of the breadth of the range.

The terms "about" or "approximately" as used herein refer to variation in the numerical quantity that can occur, for example, through typical measuring techniques and equipment, with respect to any quantifiable variable, including, but not limited to, mass, volume, time, distance, voltage, and current. Further, given solid and liquid handling procedures used in the real world, there is certain inadvertent error and variation that is likely through differences in the manufacture, source, or purity of the ingredients used to make the compositions or carry out the methods and the like. The terms "about" and "approximately" also encompass these variations. Whether or not modified by either of the terms "about" or "approximately", the claims include equivalents to the quantities.

In the preceding description, for purposes of explanation, numerous details are set forth in order to provide a thorough understanding of the embodiments. However, it will be apparent to one skilled in the art that these specific details are not required. In particular, it will be appreciated that the various additional features shown in the drawings are generally optional unless specifically identified herein as required. The above-described embodiments are intended to be examples only. Alterations, modifications and variations can be effected to the particular embodiments by those of skill in the art. The scope of the claims should not be limited by the particular embodiments set forth herein, but should be construed in a manner consistent with the specification as a whole.

What is claimed is:

1. A fence system comprising:

a plurality of fence posts;

a plurality of fence rails;

and at least one rail adapter sleeve;

wherein:

each fence rail is characterized by a fence rail longitudinal axis and a fence rail cross-sectional profile in a plane orthogonal to the fence rail longitudinal axis;

the fence rail cross-sectional profile of each fence rail has a hollow, obround shape with a side opening at one transverse side of the fence rail extending parallel to the fence rail longitudinal axis along an entire length of the fence rail;

each fence rail has an upper panel slot at an upper end of the fence rail extending parallel to the fence rail longitudinal axis, wherein each longitudinal end of the upper panel slot is spaced from a corresponding, adjacent longitudinal end of the fence rail, such that a length of the upper panel slot is less than an entire length of the fence rail;

each fence rail has a lower panel slot at a lower end of the fence rail extending parallel to the fence rail longitudinal axis, wherein each longitudinal end of the lower panel slot is spaced from a corresponding, adjacent longitudinal end of the fence rail, such that a length of the lower panel slot is less than the entire length of the fence rail;

at least some of the fence rails are male fence rails, and at least some of the fence rails are female fence rails;

each one of the male fence rails is sized and shaped such that a longitudinal end of the male fence rail is slidably insertable into a longitudinal end opening of one of the female fence rails for longitudinally-aligned mating of the male fence rail and the female fence rail;

each rail adapter sleeve is a hollow obround right prism sized and shaped such that, for each one of the male fence rails, a longitudinal end of the male fence rail is sized and shaped such that the longitudinal end of the male fence rail is slidably insertable into an opening of the rail adapter sleeve for mating the male fence rail and the rail adapter sleeve, and an outside width and an outside height of the rail adapter sleeve are substantially the same as an outside width and an outside height, respectively, of the female fence rails;

each fence post has at least one rail opening having a substantially obround shape matching the obround shape of the cross-sectional profile of the female fence rails, whereby a longitudinal end of each female fence rail is slidingly insertable into the rail opening, and each rail adapter sleeve is slidably insertable into the rail opening;

at least some of the fence posts are middle fence posts, wherein:

each middle fence post is characterized by a middle fence post vertical axis and has a substantially I-beam shape with a web extending parallel to the middle fence post vertical axis and bridging in perpendicular relation two parallel, opposing flanges each extending parallel to the middle fence post vertical axis; and the web of each middle fence post has at least one of the rail openings;

at least some of the fence posts are corner fence posts, wherein:

each corner fence post is characterized by a corner fence post vertical axis and a corner fence post cross-sectional profile in a plane orthogonal to the corner fence post vertical axis;

each corner fence post comprises a quarter-circular wall extending parallel to the corner fence post vertical axis an entire length of the corner fence post, and rectangular radial walls adjoining opposing longitudinal edges of the quarter-circular wall and extending parallel to the corner fence post vertical axis the entire length of the corner fence post;

opposing longitudinal edges of the rectangular radial walls define a slot extending parallel to the corner fence post vertical axis the entire length of the corner fence post; and the quarter-circular wall and rectangular radial walls define a corner fence post channel extending parallel to the corner fence post vertical axis; and each of the rectangular radial walls of each corner fence post has at least one of the rail openings;

at least some of the fence posts are end fence posts, wherein:

each end fence post is characterized by an end fence post vertical axis and an end fence post cross-sectional profile in a plane orthogonal to the end fence post vertical axis;

the end fence post cross-sectional profile has a shape of a rectangle having four sides corresponding to four walls extending parallel to the end fence post vertical axis, the four walls defining a channel extending parallel to the end fence post vertical axis, wherein one of the four walls is a slot wall forming an end fence post slot extending parallel to the end fence post vertical axis and sized and shaped to slidingly receive at least one hinge knuckle module; and for each corner fence post, one of the four walls adjacent the slot wall has at least one of the rail openings;

each fence rail is mounted to and supported by a corresponding, bracketing pair of the fence posts, wherein longitudinally opposing ends of the fence rail are positioned within corresponding rail openings of the bracketing pair of the fence posts;

at least one of the female fence rails is longitudinally mated with a corresponding one of the male fence rails to form an overlapping portion positioned within one of the rail openings of one of the middle fence posts;

at least one of the male fence rails has a corresponding one of the rail adapter sleeves mated at a longitudinal end of the male fence rails, and the rail adapter sleeve is positioned within one of the rail openings of one of the corner fence posts or end fence posts;

at least one pair of the fence rails comprises an upper fence rail and a lower fence rail positioned adjacent, below, and parallel to the upper fence rail, and a panel is positioned between the upper fence rail and the lower fence rail, wherein an upper edge of the panel is positioned within the lower panel slot of the upper fence rail and a lower edge of the panel is positioned within the upper panel slot of the lower fence rail; and the fence system is free from fasteners fastening any of the fence rails, the fence posts, and the rail adapter sleeve to one another.

2. A fence system comprising:

a plurality of fence posts; and a fence rail;

wherein:

the fence rail is characterized by a fence rail longitudinal axis and a fence rail cross-sectional profile in a plane orthogonal to the fence rail longitudinal axis, wherein the fence rail cross-sectional profile has a hollow, obround shape;

each fence post has at least one rail opening having a substantially obround shape matching the obround shape of the cross-sectional profile of the fence rail, whereby a longitudinal end of the fence rail is slidingly insertable into the rail opening;

the fence rail is mounted to and supported by a bracketing pair of the fence posts, wherein longitudinally opposing ends of the fence rail are positioned within corresponding rail openings of the bracketing pair of the fence posts; and the fence rail has a side opening at one transverse side of the fence rail extending parallel to the fence rail longitudinal axis.

3. The fence system of claim 2, wherein the side opening of the fence rail extends an entire length of the fence rail.

4. The fence system of claim 2, wherein the fence rail is an upper fence rail, and the fence system further comprises a lower fence rail, wherein:

the lower fence rail has an upper panel slot at an upper end of the lower fence rail extending parallel to a fence rail longitudinal axis of the lower fence rail;

the upper fence rail has a lower panel slot at a lower end of the upper fence rail extending parallel to the fence rail longitudinal axis of the upper fence rail;

the lower fence rail is positioned adjacent, below, and parallel to the upper fence rail; and a panel is positioned between the upper fence rail and the lower fence rail, wherein an upper edge of the panel is positioned within the lower panel slot of the upper fence rail and a lower edge of the panel is positioned within the upper panel slot of the lower fence rail.

5. The fence system of claim 4, wherein:

longitudinal ends of the upper panel slot are respectively spaced from corresponding, adjacent longitudinal ends of the lower fence rail, such that a length of the upper panel slot is less than an entire length of the lower fence rail; and longitudinal ends of the lower panel slot are respectively spaced from corresponding, adjacent longitudinal ends of the upper fence rail, such that a length of the lower panel slot is less than the entire length of the upper fence rail.

6. The fence system of claim 4, wherein a lower panel slot height of the lower panel slot of the upper fence rail is greater than an upper panel slot height of the upper panel slot of the lower fence rail.

7. The fence system of claim 4, wherein:

the lower panel slot defines a lower panel slot channel;

the upper panel slot defines an upper panel slot channel;

the upper edge of the panel is positioned in the lower panel slot channel;

the lower edge of the panel is positioned in the upper panel slot channel; and a lower panel slot channel height of the lower panel slot channel is greater than an upper panel slot channel height of the upper panel slot channel.

8. The fence system of claim 7, wherein:

the upper edge of the panel is spaced from an outer surface of a main body of the upper fence rail within the lower panel slot channel.

9. The fence system of claim 8, wherein:

the lower edge of the panel contacts and rests upon an outer surface of the main body of the lower fence rail within the upper panel slot channel.

10. The fence system of claim 2, wherein:

at least one of the fence posts comprises walls defining a channel extending parallel to a fence post vertical axis of the fence post, wherein one of the walls defines a slot extending parallel to the fence post vertical axis, and one of the longitudinal ends of the fence rail is positioned within the channel.

11. The fence system of claim 10, wherein the slot extends an entire length of the at least one of the fence posts.

12. The fence system of claim 10, wherein the at least one of the fence posts is an end fence post, wherein:

the end fence post has a cross-sectional shape of a rectangle with four walls extending parallel to the fence post vertical axis;

the four walls together define the channel;

one of the four walls is a slot wall which forms the slot; and a different one of the four walls adjacent the slot wall has at least one of the rail openings.

13. The fence system of claim 12, wherein the slot is sized and shaped to slidingly receive at least one hinge knuckle module.

14. The fence system of claim 2, wherein the fence rail and the plurality of fence posts are formed of extruded aluminum.

15. The fence system of claim 2 free from fasteners.

16. A fence system comprising:

a plurality of fence posts; and a fence rail;

wherein:

the fence rail is characterized by a fence rail longitudinal axis and a fence rail cross-sectional profile in a plane orthogonal to the fence rail longitudinal axis, wherein the fence rail cross-sectional profile has a hollow, obround shape;

each fence post has at least one rail opening having a substantially obround shape matching the obround shape of the cross-sectional profile of the fence rail, whereby a longitudinal end of the fence rail is slidingly insertable into the rail opening;

the fence rail is mounted to and supported by a bracketing pair of the fence posts, wherein longitudinally opposing ends of the fence rail are positioned within corresponding rail openings of the bracketing pair of the fence posts; and at least one of the fence posts has a substantially I-beam shape with a web extending parallel to a fence post vertical axis of the fence post, the web bridging in perpendicular relation two parallel, opposing flanges each extending parallel to the fence post vertical axis, the web having at least one of the at least one rail openings.

17. A fence system comprising:

a plurality of fence posts; and a fence rail;

wherein:

the fence rail is characterized by a fence rail longitudinal axis and a fence rail cross-sectional profile in a plane orthogonal to the fence rail longitudinal axis, wherein the fence rail cross-sectional profile has a hollow, obround shape;

each fence post has at least one rail opening having a substantially obround shape matching the obround shape of the cross-sectional profile of the fence rail, whereby a longitudinal end of the fence rail is slidingly insertable into the rail opening;

the fence rail is mounted to and supported by a bracketing pair of the fence posts, wherein longitudinally opposing ends of the fence rail are positioned within corresponding rail openings of the bracketing pair of the fence posts; and the fence rail is a male fence rail, and the fence system further comprises a female fence rail, wherein a longitudinal end of the male fence rail is longitudinally mated with an end opening of the female fence rail to form an overlapping portion.

18. The fence system of claim 17, wherein:

at least one of the fence posts is a middle fence post having a substantially I-beam shape with a web extending parallel to a fence post vertical axis of the fence post, the web bridging in perpendicular relation two parallel, opposing flanges each extending parallel to the fence post vertical axis, the web having at least one of the at least one rail openings; and the overlapping portion of the mated male fence rail and female fence rail is positioned in the at least one of the at least one rail openings in the web of the at least one of the fence posts.

19. A fence system comprising:

a plurality of fence posts; and a fence rail;

wherein:

the fence rail is characterized by a fence rail longitudinal axis and a fence rail cross-sectional profile in a plane orthogonal to the fence rail longitudinal axis, wherein the fence rail cross-sectional profile has a hollow, obround shape;

each fence post has at least one rail opening having a substantially obround shape matching the obround shape of the cross-sectional profile of the fence rail, whereby a longitudinal end of the fence rail is slidingly insertable into the rail opening;

the fence rail is mounted to and supported by a bracketing pair of the fence posts, wherein longitudinally opposing ends of the fence rail are positioned within corresponding rail openings of the bracketing pair of the fence posts;

at least one of the fence posts comprises walls defining a channel extending parallel to a fence post vertical axis of the fence post, wherein one of the walls defines a slot extending parallel to the fence post vertical axis, and one of the longitudinal ends of the fence rail is positioned within the channel; and the at least one of the fence posts is a corner fence post, wherein:

the corner fence post has a quarter-circular wall extending parallel to the fence post vertical axis an entire length of the corner fence post;

the corner fence post further has two rectangular radial walls each adjoining opposing longitudinal edges of the quarter-circular wall and extending parallel to the fence post vertical axis the entire length of the corner fence post;

the quarter-circular wall and the two rectangular radial walls together define the channel;

opposing longitudinal edges of the two rectangular radial walls opposite the quarter-circular wall define the slot; and each of the rectangular radial walls has at least one of the rail openings.

20. A fence system comprising:

a plurality of fence posts;

a fence rail; and a rail adapter sleeve having a substantially hollow obround right prism shape;

wherein:

the fence rail is characterized by a fence rail longitudinal axis and a fence rail cross-sectional profile in a plane orthogonal to the fence rail longitudinal axis, wherein the fence rail cross-sectional profile has a hollow, obround shape;

each fence post has at least one rail opening having a substantially obround shape matching the obround shape of the cross-sectional profile of the fence rail, whereby a longitudinal end of the fence rail is slidingly insertable into the rail opening;

the fence rail is mounted to and supported by a bracketing pair of the fence posts, wherein longitudinally opposing ends of the fence rail are positioned within corresponding rail openings of the bracketing pair of the fence posts;

a longitudinal end of the fence rail is longitudinally mated with the rail adapter sleeve; and the substantially obround shape of the at least one rail opening matches the shape of the rail adapter sleeve, and the rail adapter sleeve is positioned in the at least one rail opening.

* * * * *